US007805957B2

(12) United States Patent
Liu

(10) Patent No.: US 7,805,957 B2
(45) Date of Patent: Oct. 5, 2010

(54) TOP PLATE STRUCTURE FOR AIR CONDITIONER INSTALLED AT HIGH LOCATION

(75) Inventor: Jihong Liu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 435 days.

(21) Appl. No.: 11/661,944

(22) PCT Filed: Sep. 1, 2005

(86) PCT No.: PCT/JP2005/016001

§ 371 (c)(1),
(2), (4) Date: Jul. 3, 2007

(87) PCT Pub. No.: WO2006/027993

PCT Pub. Date: Mar. 16, 2006

(65) Prior Publication Data

US 2008/0072613 A1 Mar. 27, 2008

(30) Foreign Application Priority Data

Sep. 8, 2004 (JP) ..... 2004-261221
Dec. 8, 2004 (JP) ..... 2004-355447

(51) Int. Cl.
*F25D 17/06* (2006.01)
*F25D 17/04* (2006.01)

(52) U.S. Cl. ..... 62/419; 62/407

(58) Field of Classification Search ..... 62/259, 62/407, 409, 419; 454/347
See application file for complete search history.

(56) References Cited

U.S. PATENT DOCUMENTS 6,481,237 B2 * 11/2002 Kim ..... 62/407

FOREIGN PATENT DOCUMENTS

| | | | |
|---|---|---|---|
| JP | 6-221606 A | | 8/1994 |
| JP | 07-139753 | * | 5/1995 |
| JP | 7-139753 | | 5/1995 |
| JP | 07139753 | * | 5/1995 |
| JP | 7-91681 A | | 9/1995 |
| JP | 7-293925 A | | 11/1995 |
| JP | 10-194281 | * | 7/1998 |
| JP | 11-201496 A | | 7/1999 |
| JP | 11201496 A | * | 7/1999 |
| JP | 2001-116350 A | | 4/2001 |

* cited by examiner

*Primary Examiner*—Frantz F Jules
*Assistant Examiner*—Emmanuel Duke
(74) *Attorney, Agent, or Firm*—Birch, Stewart, Kolasch & Birch, LLP

(57) ABSTRACT

In an air conditioner for installation at a high location, a plurality of parallel reinforcement ribs 35 are formed on a top plate 32 that forms a top surface of a body casing and supports and holds a fan and a fan motor. When the top plate 32 has the same plate thickness as a top plate of the prior art including radial reinforcement ribs, the top plate 32 has a smaller maximum deflection and a higher resonance rotation speed than the prior art top plate.

12 Claims, 27 Drawing Sheets

TOP PLATE STRUCTURE FOR AIR CONDITIONER INSTALLED AT HIGH LOCATION

TECHNICAL FIELD

The present invention relates to a top plate structure for an air conditioner for installation at high locations.

BACKGROUND ART

An air conditioner (indoor unit) that is installed at a high location, such as an air conditioner that is concealed in or suspended from a ceiling of a house, may use, for example, a metal top plate to form the top surface of a cassette body casing. The air conditioner is concealed in the ceiling or suspended from a lower surface of the ceiling by suspending the main body casing and suspending heavy objects such as the heat exchanger, fan, fan motor, drain pump, and switching box from a top plate and then suspending the main body casing with suspension bolts or the like.

An example of a high location installation type air conditioner is shown as a ceiling concealed type air conditioner in FIGS. 41 to 43.

As shown in FIGS. 41 to 43, the air conditioner is formed by setting an air conditioner body 1 in an opening 7 formed in a ceiling C, and attaching a decorative panel 2 covering the opening 7 to the air conditioner body 1. The air conditioner body 1 has a cassette body casing 3. The body casing 3 accommodates a substantially annular heat exchanger 4, a fan (or impeller) 5, a fan motor 9, and a bell mouth 6. The fan 5 is arranged at the central portion of the heat exchanger 4 in a manner that its air inlet side faces downward and its air outlet side faces the side of the heat exchanger 4. The bell mouth 6 is made of synthetic resin and arranged at the air inlet side of the fan 5.

The fan 5 has a large number of blades 5*c* arranged between a hub 5*b* and a shroud 5*c*. A drain pan 8 is arranged below the heat exchanger 4, and an air outlet passage 10 is formed around the heat exchanger 4.

The body casing 3, which has a substantially hexagonal horizontal cross-section, includes a side wall 3*a*, which is formed from a heat insulating material, and a top plate 32, which covers an upper portion of the side wall 3*a*.

The heat exchanger 4 includes a pair of opposing open ends. Two tube plates 4*a* are respectively arranged on the two open ends. A predetermined partition plate 12 connects the two tube plates 4*a* to each other.

The top plate 32 of the body casing 3, the two tube plates 4*a*, the partition plate 12, and a switch box 13 attached to a lower surface of the bell mouth 6 are all made of metal plates. As shown in FIG. 43, the top plate 32 and the switch box 13 are fixed to the top and bottom ends of the partition plate 12 by screws.

The bell mouth 6 has a recessed portion 14, which is for accommodating the switch box 13, and an opening 16 formed in a top surface 14*a* of the recessed portion 14. A switch box joint 15 formed on a lower end portion of the partition plate 12 is arranged in the opening 16.

A pair of attachment tabs 17 joined to the top plate 32 is formed on two sides of an upper end portion of the partition plate 12 in a manner that the attachment tabs 17 project integrally from the upper end portion of the partition plate 12. The two attachment tabs 17 are fixed to the top plate 32 from under the top plate 32 via screws 18.

A pair of attachment tabs 19 that is joined to lower ends of the two tube plates 4*a* is formed on two sides of a lower end portion of the partition plate 12 in a manner that the attachment tabs 19 project integrally from the lower end portion of the partition plate 12. An attachment tab 15 connected to the switch box 13 is welded and fixed to a location between the two attachment tabs 19. The two attachment tabs 19 are fixed to the two tube plates 4*a* from under the tube plates 4*a* by screws 20. The attachment tab 15 has an L-shaped basal portion 15*a* that is joined to the partition plate 12 and a attachment portion 15*b* that is formed integrally with a distal end of the basal portion 15*a* to extend downward from the distal end of the basal portion 15*a*. In a state in which the attachment portion 15*b* extends from the opening 16 and into the recessed portion 14, the attachment tab 15 is fixed to a top surface 13*a* of the switch box 13 by screws 21.

As shown in FIGS. 41 to 43, the air conditioner includes a drain pump 22, a float switch 23, a drain pump accommodation portion 24 in which the drain pump 22 is arranged, a partition plate 25 partitioning the drain pump accommodation portion 24, and a lid cover 26 of the switch box 13.

The top plate 32, which has a substantially hexagonal shape in correspondence with the shape of the body casing 3 in the air conditioner body 1, includes a hook-shaped rim portion 32*c* for fitting the top plate 32 to the periphery of an upper end portion of a side wall 31 of the body casing 3.

The top plate 32 has a plurality of main reinforcement ribs 32*a* that extend radially from a substantially central portion 33 at which the fan 5 and the fan motor 9 are supported to a peripheral portion at which the substantially annular heat exchanger 4 is supported. The main reinforcement ribs 32*a* are recessed downward and have a predetermined width and a predetermined depth. The peripheral portion of the heat exchanger supporting portion of each main reinforcement rib 32*a* includes a stepped portion 32*b*, which extends downward and has a small depth.

The main reinforcement ribs 32*a* set basic rigidity (deflection characteristics), strength, and vibration characteristics of the top plate 32 at required levels.

In the above-described structure, the distance between the main reinforcement ribs 32*a* increases at the peripheral portion of the top plate 32. This may accordingly lower the rigidity, strength, etc. of the peripheral portion of the top plate 32. To prevent this, a plurality of sub-reinforcement ribs 34 are arranged between the main reinforcement ribs 32*a* as shown in FIG. 43. Each sub-reinforcement rib 34 has the desired shape and size set in accordance with an assumed load of the top plate 32. During the design stage, to keep the static deflection of the top plate 32 at a certain value or lower and avoid resonance that would be caused by the rotation produced by the fan motor 9, the primary natural vibration frequency of the top plate 32 is maintained to have a certain value or higher. Further, reinforcement ribs 33*a*, which are substantially triangular when seen from above, are also arranged at the substantially central portion 33 of the top plate 32 that supports the fan 5 and the fan motor 9. This improves rigidity (deflection characteristics), strength, and vibration characteristics of the supporting portions at which the fan 5 and the fan motor 9 are supported (refer to patent document 1).

The fan and fan motor supporting portion, which is reinforced by the reinforcement ribs 33*a*, has a circular grooves formed at each corner defined by the base and vertex. Three fan motor attachment portions a, b, and c are formed at the central portion of each groove. The fan motor 9 is suspended from and fixed to the fan motor attachment portions a, b, and c by mounting members 11, which absorb vibrations, and a mounting bracket 9*b*. The fan 5 is rotatably supported about a rotation shaft 9*a* of the fan motor 9.

Patent Document 1: Japanese Laid-Open Patent Publication No. 11-201496

In recent years, there has been a demand for lowering the cost of the above air conditioner including the cost of the top plate 32. To reduce the cost of the top plate 32, the entire plate thickness of the top plate 32 may be reduced (to a plate thickness of, for example, about 0.6 to 0.7 mm) from the present plate thickness (of, for example, 0.8 mm). This would reduce the material cost and facilitate the processing of the ribs etc.

However, in such cases, the rigidity and strength of the top plate 32 would decrease, and measures for preventing vibrations when the fan is driven would become necessary. When the top plate is formed to be thinner than it is now, the material cost of the top plate would be reduced, the top plate would easily be deformed, less force would be required to press and form the top plate, and the processing of the top plate would be facilitated.

However, when the thickness of the top plate is reduced, in the case of the prior art structure described above (i.e., the top plate having radial reinforcement ribs), the static deflection would increase and the primary natural vibration frequency would decrease. Thus, level of the prior art top plates would not satisfy the design standards.

Further, there are many reinforcement ribs having complicated shapes. Such reinforcement ribs would not only increase the cost of molds used when pressing the reinforcement ribs but would also increase the tendency of creases, cracks, and warps being formed.

DISCLOSURE OF THE INVENTION

Accordingly, it is an object of the present invention to provide a top plate structure for an air conditioner that enables the top plate to have the required rigidity, strength, and vibration characteristics.

To achieve the above object, in a first aspect of the present invention, a top plate structure for an air conditioner includes a body casing for accommodating a fan, a fan motor, and a heat exchanger. The top plate structure has a top plate forming a top surface of the body casing and supporting the fan and the fan motor and a plurality of parallel reinforcement ribs arranged in parallel on the top plate.

With this structure, when the top plate including the plurality of parallel reinforcement ribs extending in parallel has a plate thickness that is the same as a prior art top plate incurring radial reinforcement ribs, the top plate including the plurality of parallel reinforcement ribs has a smaller maximum deflection and a higher resonance rotation speed than the prior art top plate. This improves the static characteristics of the air conditioner. Further, even if the top plate of the present invention has a smaller plate thickness than the prior art top plate, by optimally adjusting the quantity and the width of the parallel reinforcement ribs, the maximum deflection decreases and the resonance rotation speed increases as compared with the prior art top plate. Thus, the cost of the top plate can be expected to be reduced by reduction in material cost. Further, the top plate has a higher primary natural vibration frequency. Thus, measures for preventing the generation of noise when the top plate vibrates as the fan motor produces rotation may easily be taken.

In a second aspect of the present invention, a top plate structure for an air conditioner includes a body casing for accommodating a fan, a fan motor, and a heat exchanger. The top plate structure includes a top plate forming a top surface of the body casing and supporting the fan and the fan motor and parallel reinforcement ribs and a non-parallel reinforcement rib arranged on the top plate. The parallel reinforcement ribs are arranged in parallel, and the non-parallel reinforcement rib includes a parallel portion extending parallel to the parallel reinforcement ribs and a non-parallel portion extending from an end of the parallel portion at a predetermined angle.

With this structure, when the top plate including the parallel reinforcement ribs and the non-parallel reinforcement ribs has a plate thickness that is the same as a prior art top plate including radial reinforcement ribs, the top plate including the plurality of parallel reinforcement ribs has a smaller maximum deflection and a higher resonance rotation speed than the prior art top plate. This improves static characteristics of the air conditioner. Further, even if the top plate of the present invention has a smaller plate thickness than the prior art top plate, by optimally adjusting the quantity and the width of the parallel reinforcement ribs, the maximum deflection decrease and the resonance rotation speed increases as compared with the prior art top plate. Thus, the cost of the top plate can be expected to be reduced by reduction in material cost. Further, the top plate has a higher primary natural vibration frequency. Thus, measures for preventing the generation of noise when the top plate vibrates as the fan motor produces rotation may easily be taken. Additionally, the occurrence of warping during press work can be avoided.

Each reinforcement rib may have a width that is substantially equal to the distance between the reinforcement ribs. In such a case, the arrangement balance of the reinforcement ribs on the top plate is optimized. Thus, the maximum deflection is decreased, and the resonance rotation speed is increased.

Each reinforcement rib may have a distance that differs from the distance between the reinforcement ribs. In such a case, the freedom for setting rigidity (deflection characteristics), strength, and vibration characteristics of the top plate is improved.

Each reinforcement rib may have a width that is 5 to 15% of the width of the top plate. In such a case, even when the top plate has a small thickness, the top plate has a smaller maximum deflection and a higher resonance rotation speed than the prior art top plate. Thus, the cost of the top plate can be expected to be reduced by reduction in material cost. When the width of each reinforcement rib is less than 5%, an excessively large number of reinforcement ribs are formed thereby making the reinforcement ribs difficult to form, and when exceeding 15%, there will not be enough reinforcement ribs and the effect of the reinforcement ribs will become insufficient.

Among the plurality of reinforcement ribs, the reinforcement rib located at the middle may be formed to be linear. In such a case, a portion of the top plate to which the fan motor is attached has a higher rigidity. This lowers the maximum deflection and increases the resonance rotation speed. Thus, the cost of the top plate can be expected to be reduced by reduction in the material cost.

Each reinforcement rib may have a depth set in a range of 7 to 11 mm. This lowers the maximum deflection and increases the resonance rotation speed. Thus, the cost of the top plate can be expected to be reduced by reduction in the material cost. The maximum deflection of the top plate is further decreased and the resonance rotation speed of the top plate is increased as the depth of each reinforcement rib increases. However, to satisfy the design standard, it is preferred that the upper limit of the depth of each reinforcement rib is 11 mm.

Among the plurality of reinforcement ribs, the reinforcement rib located at the middle may have a depth that differs from the depth of the other reinforcement ribs. This lowers the maximum deflection and increases the resonance rotation speed. Thus, the cost of the top plate can be expected to be reduced by reduction in the material cost.

The plurality of reinforcement ribs may extend alternately from a front side or a rear side of the top plate. This lowers the maximum deflection and increases the resonance rotation speed. Thus, the cost of the top plate can be expected to be reduced by reduction in the material cost.

Each reinforcement rib may have two ends at which the depth is set to be shallower than the depth at a middle portion. This further lowers the maximum deflection. Thus, the cost of the top plate can be expected to be reduced by reduction in the material cost.

The top plate may have a plate thickness set in a range of 0.6 to 0.7 mm. In this case, the cost of the top plate can be expected to be reduced by reduction in the material cost.

It is preferred that the air conditioner be of a type for installation at a high location.

BEST MODE FOR CARRYING OUT THE INVENTION

Preferred embodiments of the present invention will now be described with reference to the attached drawings.

First Embodiment

Figure 1:
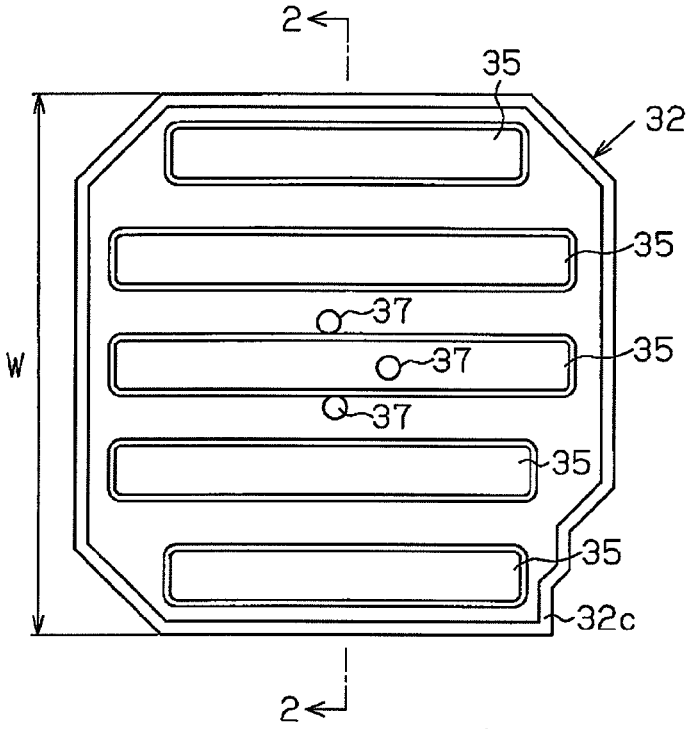
FIG. 1 is a bottom view showing a top plate structure for an air conditioner for installation at a high location according to a first embodiment.
Figure 2:
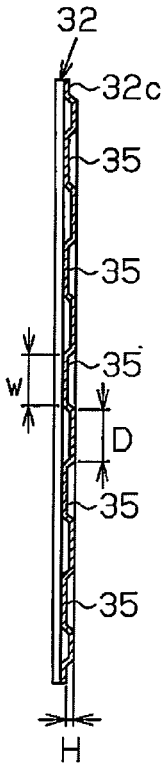
FIG. 2 is a cross-sectional view taken along line 2-2 of FIG. 1.

FIGS. 1 and 2 show a top plate structure for an air conditioner for installation at a high location according to a first embodiment of the present invention.

Figure 41:
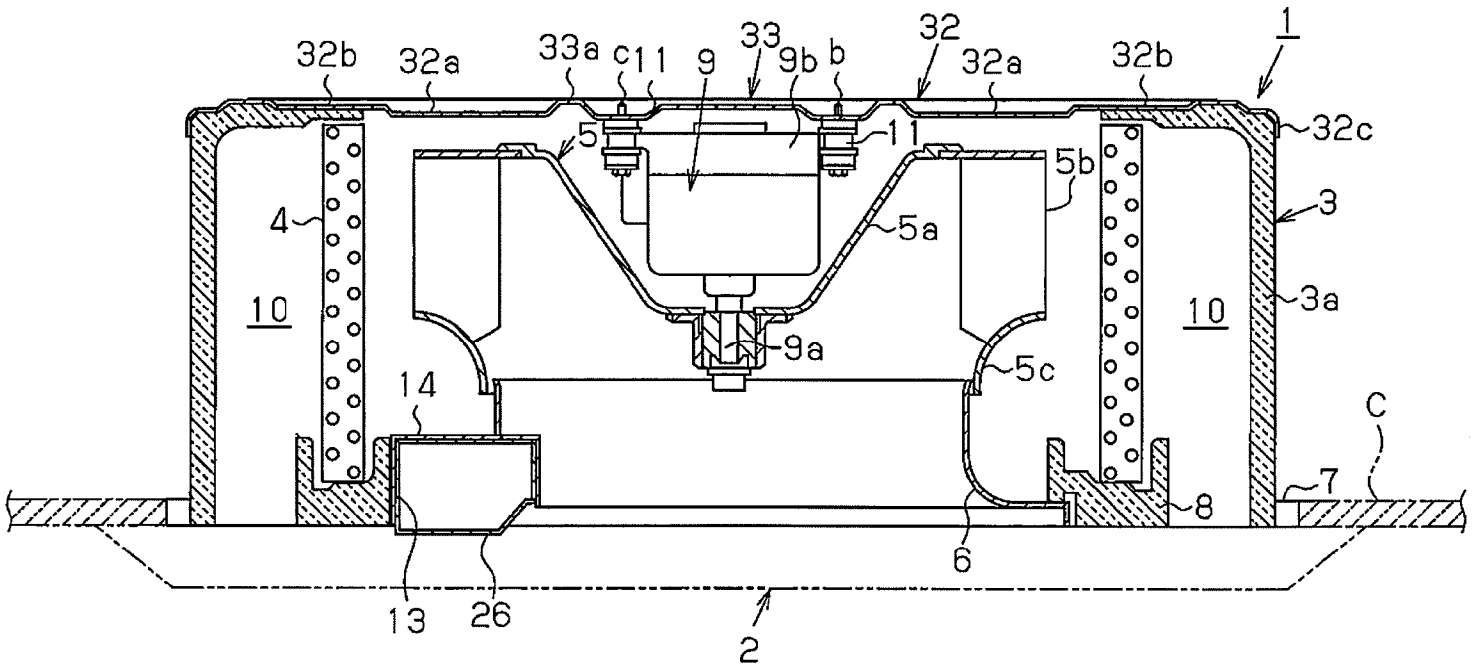
Fig.41 (Prior Art)
FIG. 41 is a central, vertical cross-sectional view showing the entire structure of a prior art air conditioner.
Figure 42:
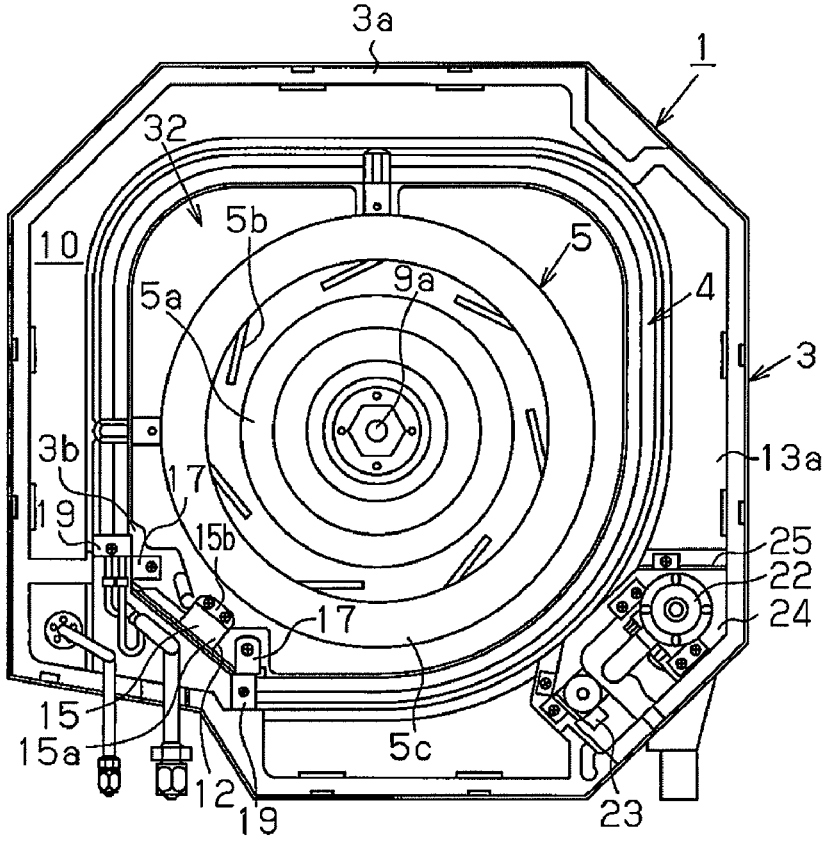
Fig.42 (Prior Art)
FIG. 42 is a bottom view showing the prior art air conditioner from which a decorative panel and a body casing are removed from below.
Figure 43:
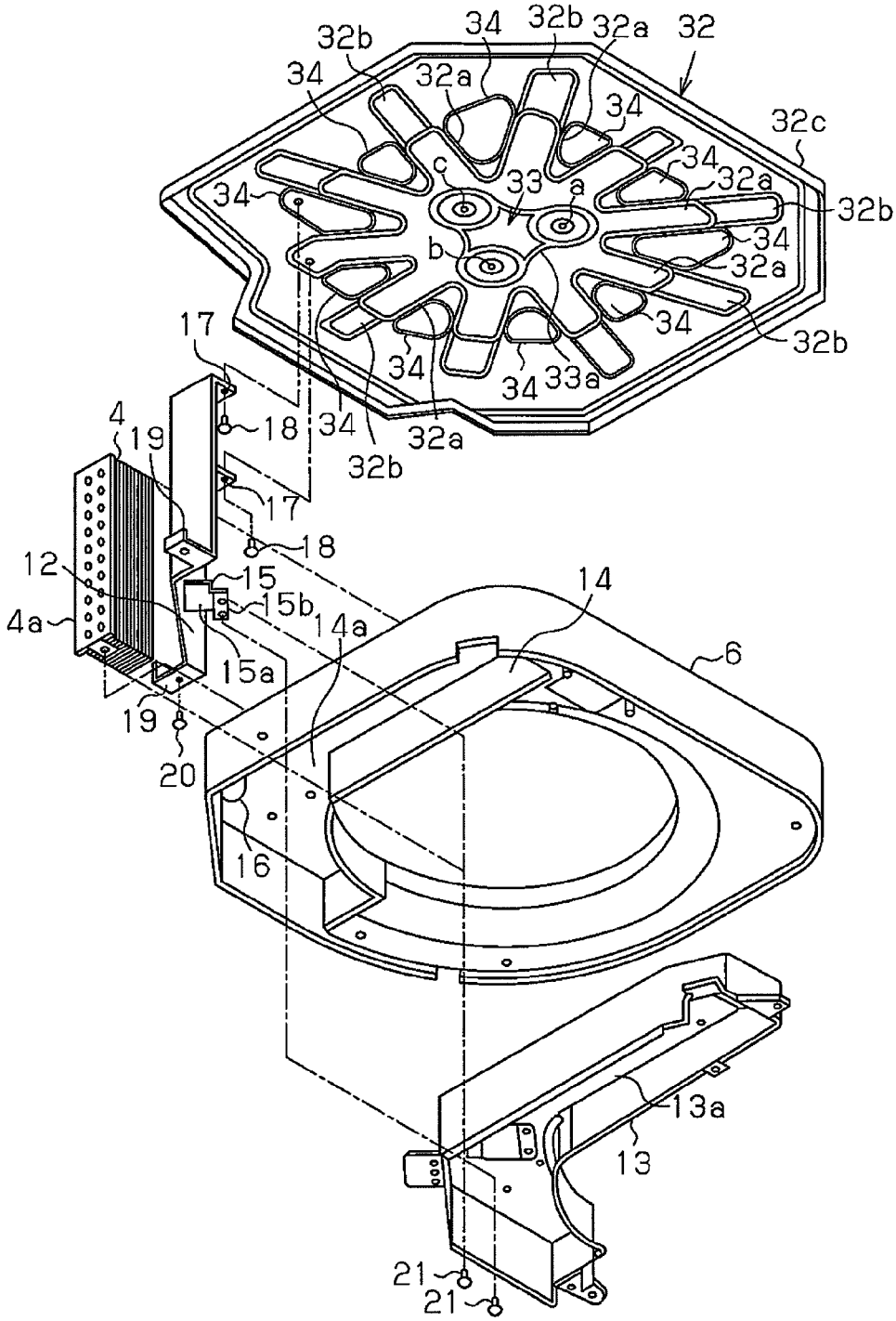
Fig.43 (Prior Art)
FIG. 43 is an exploded perspective view showing the attaching relationship between a top plate portion, a bell mouth, a switch box, etc. of the prior art air conditioner.

A top plate 32 is formed to be optimal for use with a body casing 3 of a ceiling concealed air conditioner (indoor unit) that is the same as that of the prior art example shown in FIGS. 41 to 43.

The top plate 32, which has a plate thickness t (about 0.6 mm) that is smaller than the thickness of the prior art top plate (0.8 mm), is formed to have, for example, a substantially hexagonal shape corresponding to the shape of a cassette body casing 3 included in the ceiling concealed air conditioner as shown in FIG. 1. A rim portion 32*c* having a hook-shaped cross-section is formed along the periphery of the top plate 32 to fit the top plate 32 to the periphery of an upper end portion of a heat insulating member 3*a* (refer to FIG. 41), which forms the side wall of the body casing 3.

The top plate 32 has five parallel reinforcement ribs 35 arranged in parallel in a width W direction of the top plate 32 as shown in FIG. 1. Flat portions extend between the parallel reinforcement ribs 35. Each parallel reinforcement rib 35 has a trapezoidal cross-section. The rib width w is substantially equal to the distance D between reinforcement ribs 35 and 35, and the depth H of each reinforcement rib 35 is 8.8 mm. Further, the rib width w of each reinforcement rib 35 is preferably 5 to 15% of the width W of the top plate 32, and more preferably 10% of the width W. When this is set to less than 5%, an excessively large number of reinforcement ribs must be formed thereby making the reinforcement ribs difficult to form. If this is set to more than 15%, there will not be enough reinforcement ribs and the effect of the reinforcement ribs will become insufficient. Fan motor attachment portions 37 are formed at the central portion of the top plate 32.

With the above-described structure, when the top plate 32 including the plurality of parallel reinforcement ribs 35 arranged in parallel is formed to have the same plate thickness as the prior art top plate including the radial reinforcement ribs are formed, the top plate 32 has a smaller maximum deflection and a higher resonance rotation speed than the prior art top plate. This structure improves static characteristics of the air conditioner installed at a high location. Further, even if the top plate 32 is formed to have a smaller plate thickness than the prior art top plate, by optimally adjusting the quantity and width of the parallel reinforcement ribs 35, the maximum deflection is lowered and the resonance rotation speed is improved as compared with the prior art top plate. Further, the cost of the top plate 32 can be expected to be lowered due to the reduction in material cost. Additionally, the top plate 32 has a higher primary natural vibration frequency. This facilitates the prevention of noise that would be generated when the top plate 32 vibrates as the fan motor 9 produces rotation.

Second Embodiment

Figure 3:
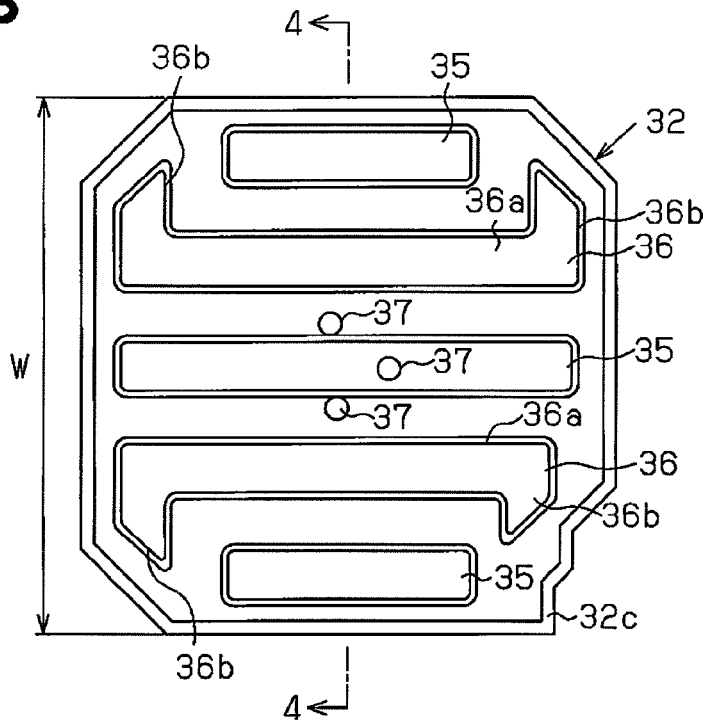
FIG. 3 is a bottom view showing a top plate structure for an air conditioner for installation at a high location according to a second embodiment.
Figure 4:
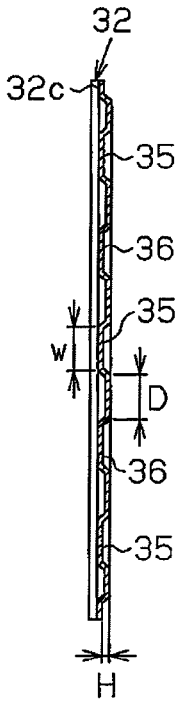
FIG. 4 is a cross-sectional view taken along line 4-4 of FIG. 3.

FIGS. 3 and 4 show a top plate structure for an air conditioner for installation at a high location according to a second embodiment of the present invention.

In this case, a top plate 32 includes parallel reinforcement ribs 35 that are arranged in parallel and non-parallel reinforcement ribs 36, each of which has a parallel portion 36*a* arranged in parallel with the parallel reinforcement ribs 35 and non-parallel portions 36*b* extending from distal ends of the parallel portion 36*a* at a predetermined angle. More specifically, the parallel reinforcement ribs 35 are formed at the outermost positions and at the middle position in the widthwise direction of the top plate 32, and the non-parallel reinforcement ribs 36 are formed between the parallel reinforcement ribs 35. Further, the non-parallel portions 36*b* of each non-parallel reinforcement rib 36 extend outward at right angles from the two distal ends of the parallel portion 36*a*. Further, the top plate 32 has flat portions formed between the reinforcement ribs 35 and 36. The reinforcement ribs 35 and 36 each have a trapezoidal cross-section. The rib width w is substantially equal to the distance D between the reinforcement ribs 35 and 36, and the reinforcement ribs 35 and 36 each have a depth H of 8.8 mm. The rib width w of each of the reinforcement ribs 35 and 36 is preferably 5 to 15% of the width W of the top plate 32, and more preferably 10% of the width W. When this is set to less than 5%, an excessively large number of reinforcement ribs must be formed thereby making the reinforcement ribs difficult to form. If this is set to more than 15%, there will not be enough reinforcement ribs and the effect of the reinforcement ribs will become insufficient. Further, in this case, the reinforcement rib positioned in the middle among the plurality of reinforcement ribs 35 and 36 has a linear shape. This strengthens rigidity of the portion of the top plate 32 to which the fan motor 9 is attached, lowers the maximum deflection, and increases the resonance rotation speed. Thus, the cost of the top plate is expected to be further reduced due to lower material costs. The other parts are the same as the first embodiment and will not be described.

With the above-described structure, when the plate thickness is the same as that of the prior art top plate, compared to the prior art top plate in which the top plate 32 includes the radial reinforcement ribs, the top plate 32 has a smaller maximum deflection and a higher resonance rotation speed. This improves the static characteristics of the air conditioner installed at a high location. Further, even if the top plate 32 has a smaller plate thickness than the prior art top plate, by optimally adjusting the quantity and width of the reinforcement ribs 35 and the non-parallel reinforcement ribs 36, the maximum deflection is lowered, and the resonance rotation speed is improved. Further, the cost of the top plate 32 can be expected to be lowered due to the reduction in material cost. Additionally, the top plate 32 has a higher primary natural vibration frequency. This facilitates the prevention of noise that would be generated when the top plate 32 vibrates as the fan motor 9 produces rotation. Further, the non-parallel portions 36*b* prevent the top plate 32 from warping when pressed.

In each of the above embodiments, the rib width w of each reinforcement rib and the distance D between the reinforcement ribs are set to be substantially equal. However, the rib width w of each reinforcement rib may differ from the distance D between the reinforcement ribs. In such a case, the freedom for setting rigidity (deflection characteristics), strength, and vibration characteristics of the top plate 32 would be improved.

TEST EXAMPLES

To verify the effects described above, or the influence the quantity and arrangement etc. of the reinforcement ribs 35 and 36 has on the behavior of the top plate 32, various kinds of sample top plates (sample Nos. 1 to 14) were prepared, and the maximum deflection and the resonance rotation speed of each sample plate were analyzed.

This analysis (FEM analysis) uses finite element analysis software (I-DEAS MS9m2 Model Solution created by EDF).

(1) Sample No. 1

Figure 5:
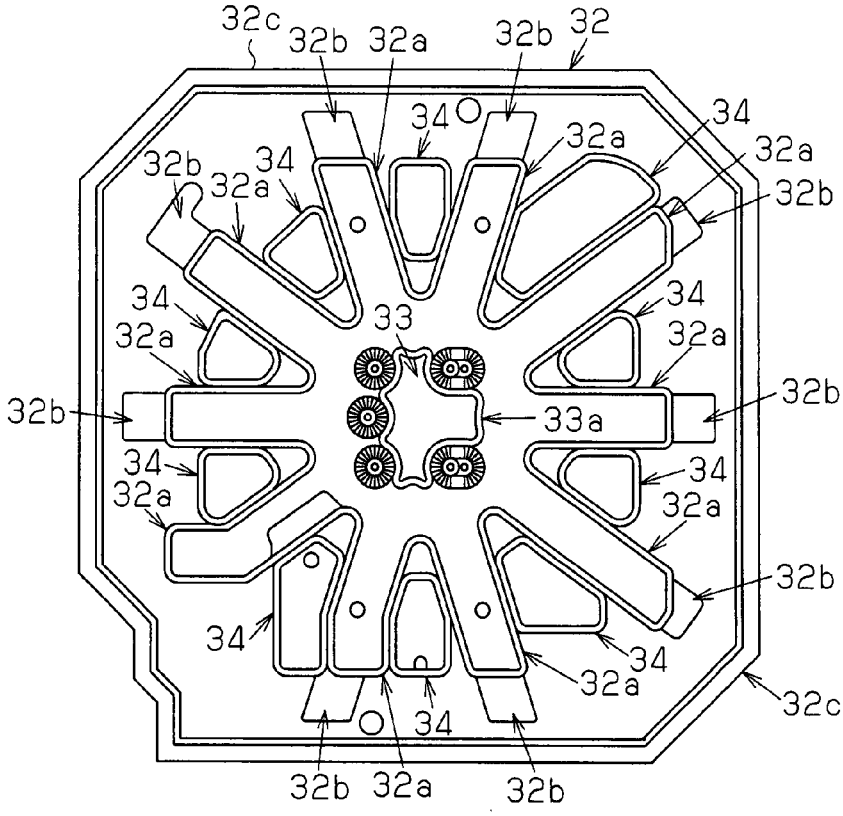
FIG. 5 is a bottom view showing a top plate structure of sample No. 1.

As shown in FIG. 5, a top plate 32 includes a plurality of main reinforcement ribs 32*a* extending radially from a substantially central portion 33 to a peripheral portion of the top plate 32, stepped portions 32*b* located at the outer side of the main reinforcement ribs 32*a*, and a plurality of sub reinforcement ribs 34 arranged adjacent to the main reinforcement ribs 32. The main reinforcement ribs 32*a*, which are recessed downward, each have a predetermined width and a predetermined depth. The stepped portions 32*b* are recessed downward less than the main reinforcement ribs 32*a*. The sub reinforcement ribs 34 each have a desired shape and size. In other words, the top plate 32 has substantially the same structure as the prior art example described above shown in FIG. 43. The reinforcement ribs 32*a* and 34 each have a depth of 8.8 mm.

(2) Sample No. 2

Figure 6:
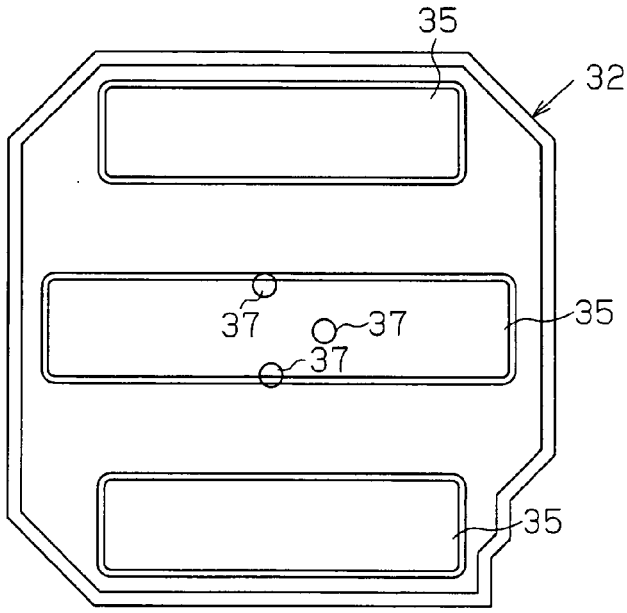
FIG. 6 is a bottom view showing a top plate structure of sample No. 2.

As shown in FIG. 6, a top plate 32 includes three parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(3) Sample No. 3

Figure 7:
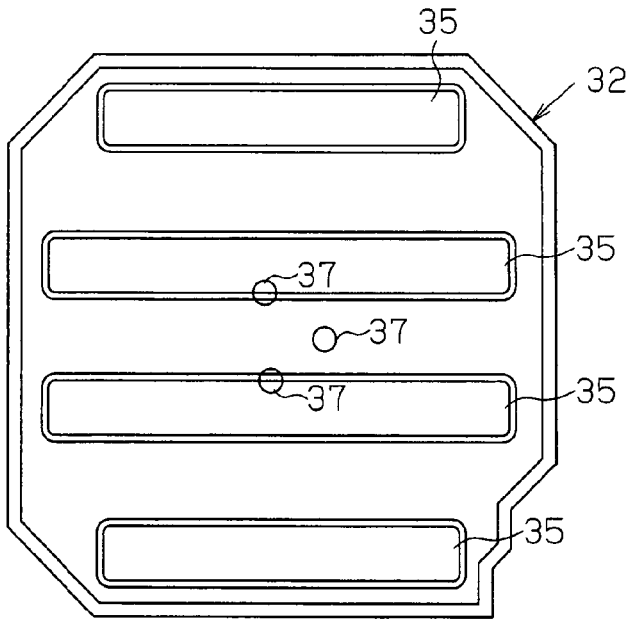
FIG. 7 is a bottom view showing a top plate structure of sample No. 3.

As shown in FIG. 7, a top plate 32 includes four parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(4) Sample No. 4

Same as that of the First Embodiment

Figure 8:
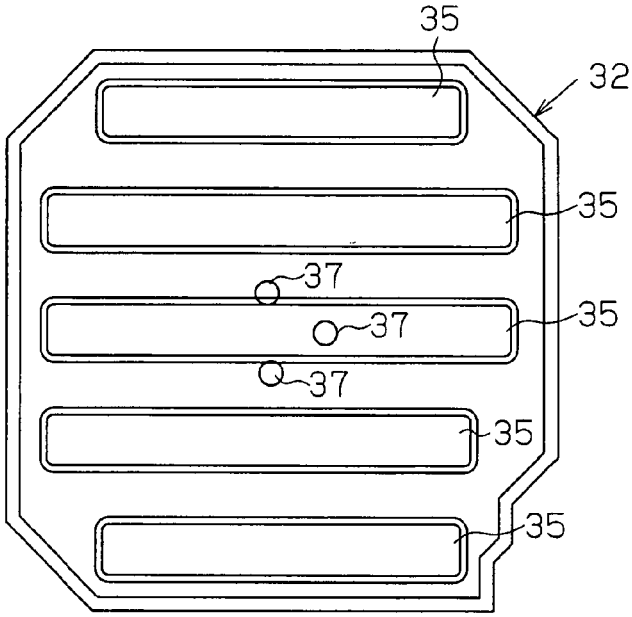
FIG. 8 is a bottom view showing a top plate structure of sample No. 4.

As shown in FIG. 8, a top plate 32 includes five parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(5) Sample No. 5

Figure 9:
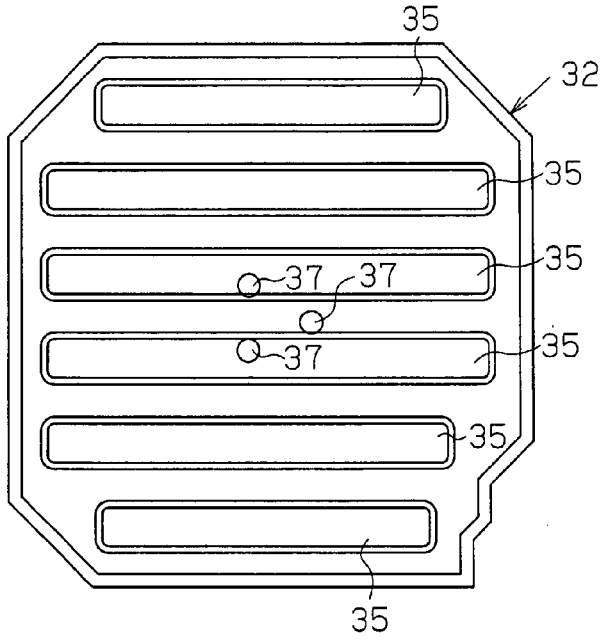
FIG. 9 is a bottom view showing a top plate structure of sample No. 5.

As shown in FIG. 9, a top plate 32 includes six parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(6) Sample No. 6

Figure 10:
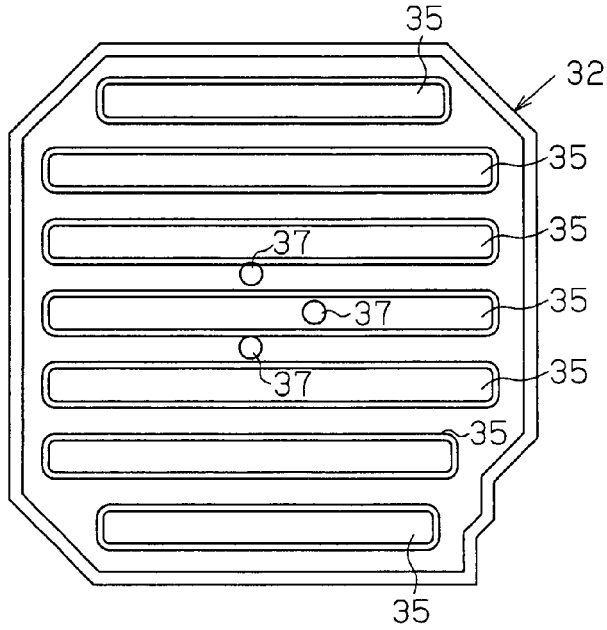
FIG. 10 is a bottom view showing a top plate structure of sample No. 6.

As shown in FIG. 10, a top plate 32 includes seven parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(7) Sample No. 7

Figure 11:
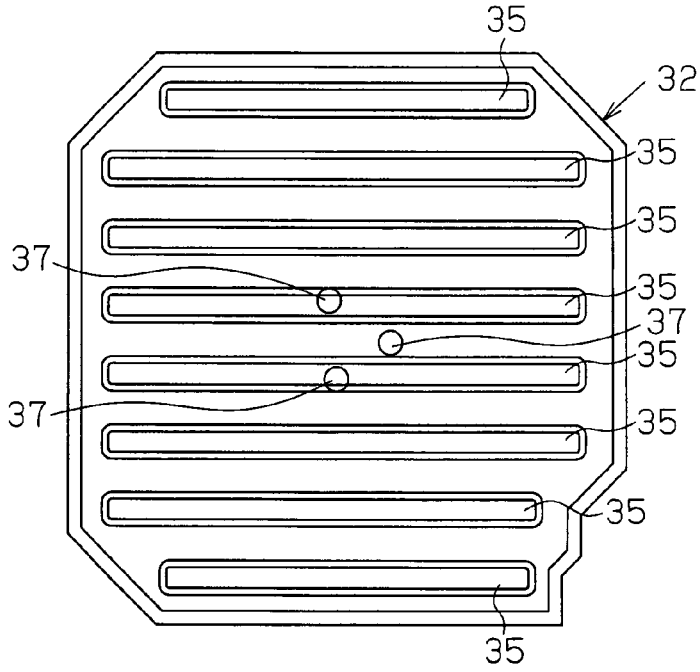
FIG. 11 is a bottom view showing a top plate structure of sample No. 7.

As shown in FIG. 11, a top plate 32 includes eight parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(8) Sample No. 8

Figure 12:
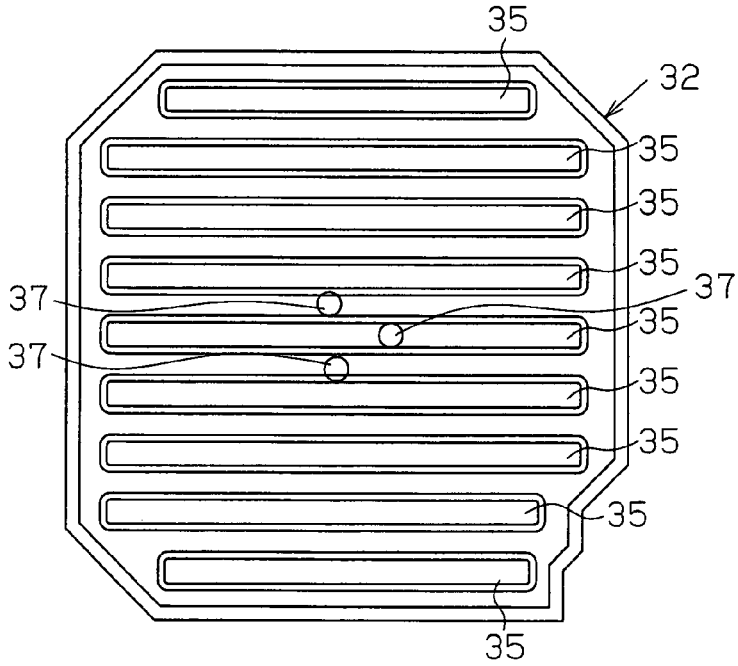
FIG. 12 is a bottom view showing a top plate structure of sample No. 8.

As shown in FIG. 12, a top plate 32 includes nine parallel reinforcement ribs 35. Each parallel reinforcement rib 35 has a width w that is substantially equal to the distance D between the parallel reinforcement ribs 35. Each parallel reinforcement rib 35 has a depth H of 8.8 mm, which is the same as that of the prior art (sample No. 1).

(9) Sample No. 9

Figure 13:
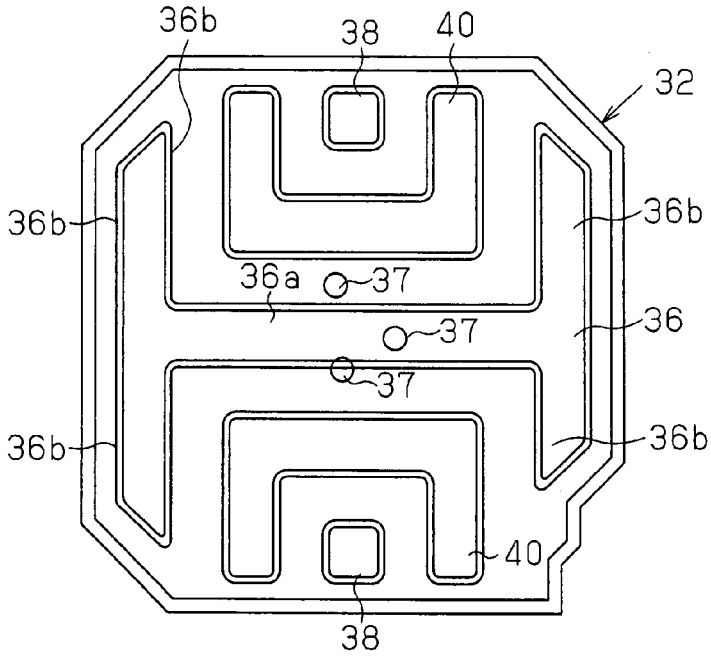
FIG. 13 is a bottom view showing a top plate structure of sample No. 9.

As shown in FIG. 13, a top plate 32 includes a non-parallel reinforcement rib 36, which has a parallel portion 36*a* located at a middle portion of the top plate 32 in the widthwise direction of the top plate 32 and a pair of non-parallel portions 36*b* extending at right angles from the two distal ends of the parallel portion 36*a*, a pair of U-shaped non-parallel reinforcement ribs 40 located outward from the non-parallel reinforcement rib 36, and two square reinforcement ribs 38 located in the middle of the corresponding non-parallel reinforcement rib 40. The reinforcement ribs 36, 38, and 40 each have a width w that is substantially equal to the distance D between the parallel reinforcement ribs 36, 38, and 40. The parallel reinforcement ribs 36, 38, and 40 each have a depth H of 8.8 mm, which is the same as that of the prior art (sample No. 1).

(10) Sample No. 10

Figure 14:
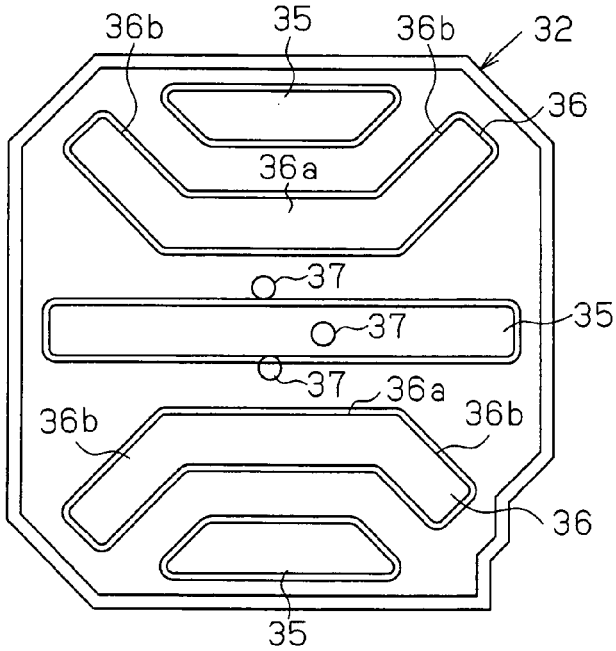
FIG. 14 is a bottom view showing a top plate structure of sample No. 10.

As shown in FIG. 14, a top plate 32 includes parallel reinforcement ribs 35, which are located at the outermost side of the top plate 32 in the widthwise direction of the top plate 32 and a middle portion of the top plate 32, and two non-parallel reinforcement ribs 36, each of which has a parallel portion 36*a* located between the parallel reinforcement ribs 35 and non-parallel portions 36*b* extending outward from the two distal ends of the parallel portion 36*a* at an angle of 45 degrees. The reinforcement ribs 35 and 36 each have a width w that is substantially equal to the distance D between the reinforcement ribs 35 and 36. The reinforcement ribs 35 and 36 each have a depth H of 8.8 mm, which is the same as that of the prior art (sample No. 1).

(11) Sample No. 11

Figure 15:
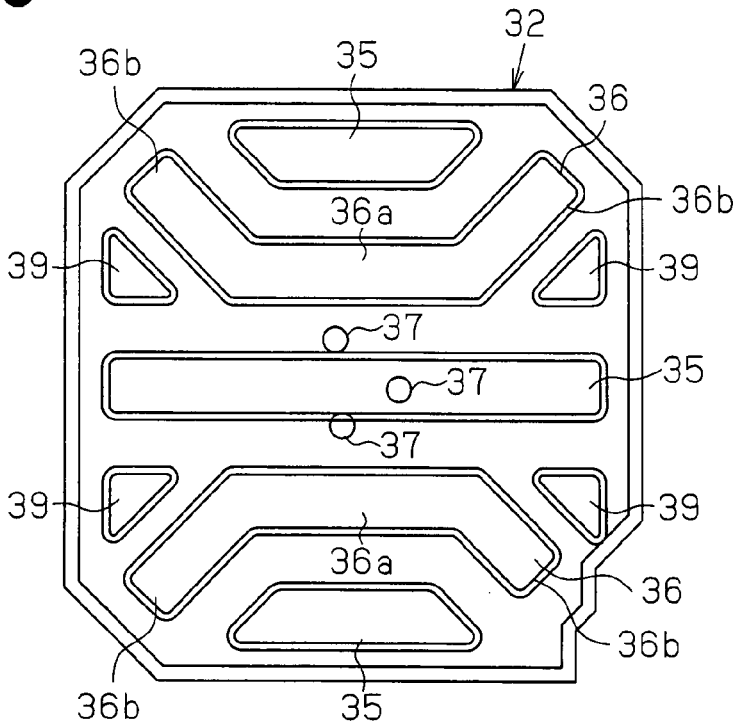
FIG. 15 is a bottom view showing a top plate structure of sample No. 11.

As shown in FIG. 15, a top plate 32 includes triangular reinforcement ribs 39 in addition to the structure of the top plate 32 of sample No. 10. The triangular reinforcement ribs 39 are arranged between a parallel reinforcement rib 35 located at a middle portion of the top plate 32 in the widthwise direction and a non-parallel portions 36*b* of a non-parallel reinforcement ribs 36 of the top plate 32. The reinforcement ribs 35 and 36 each have a width w that is substantially equal to the distance D between the reinforcement ribs 35 and 36. The reinforcement ribs 35 and 36 each have a depth H of 8.8 mm, which is the same as that of the prior art (sample No. 1).

(12) Sample No. 12

Figure 16:
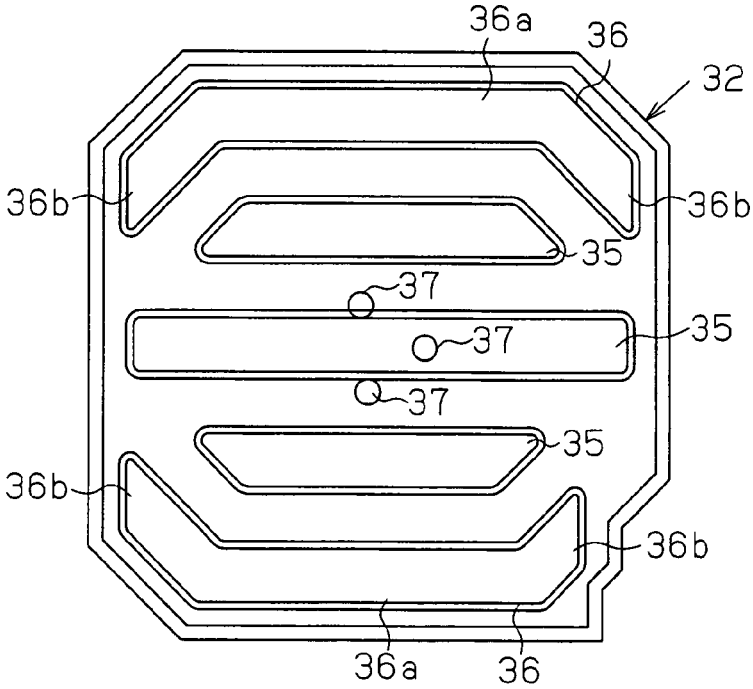
FIG. 16 is a bottom view showing a top plate structure of sample No. 12.

As shown in FIG. 16, a top plate 32 includes three parallel reinforcement ribs 35 located in a middle portion of the top plate 32 in the widthwise direction of the top plate 32 and two non-parallel reinforcement ribs 36, each having a parallel portion 36*a* located at the outermost side of the top plate 32 in the widthwise direction and non-parallel portions 36*b* extending inward from the two distal ends of the parallel portion 36 at an angle of 45 degrees. The reinforcement ribs 35 and 36 each have a width w that is substantially equal to the distance D between the reinforcement ribs 35 and 36. The reinforcement ribs 35 and 36 each have a depth H of 8.8 mm, which is the same as that of the prior art (sample No. 1).

(13) Sample No. 13

Same as the Second Embodiment

Figure 17:
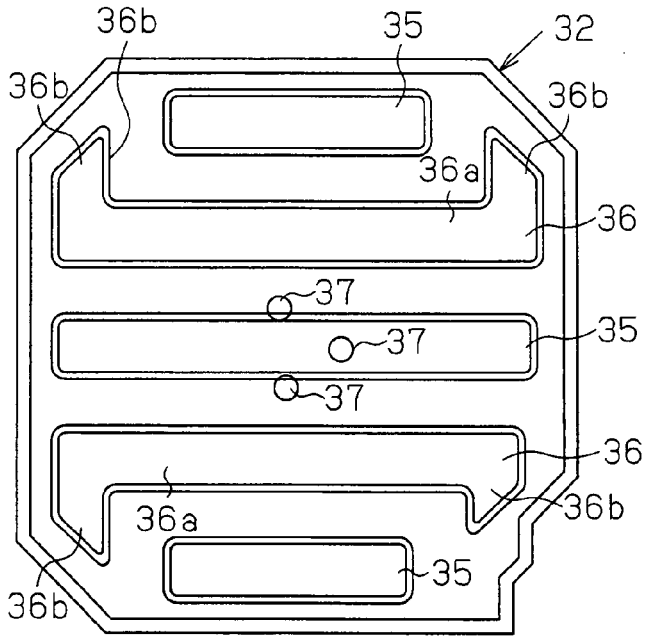
FIG. 17 is a bottom view showing a top plate structure of sample No. 13.

As shown in FIG. 17, a top plate 32 includes three parallel reinforcement ribs 35, which are located at the outermost side of the top plate 32 in the widthwise direction of the top plate 32 and in the middle portion of the top plate 32, and non-parallel reinforcement ribs 36, each having a parallel portion 36*a* located between the parallel reinforcement ribs 35 and non-parallel portions 36*b* extending outward from the two distal ends of the parallel portion 36*a* at an angle of 45 degrees. The reinforcement ribs 35 and 36 each have a width w that is substantially equal to the distance D between the reinforcement ribs 35 and 36. The reinforcement ribs 35 and 36 each have a depth H of 8.8 mm, which is the same as that of the prior art (sample No. 1).

(14) Sample No. 14

Figure 18:
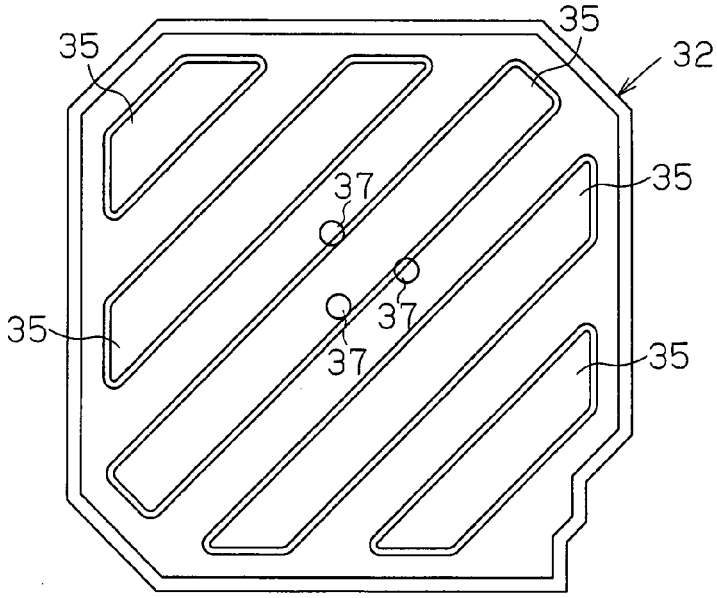
FIG. 18 is a bottom view showing a top plate structure of sample No. 14.

As shown in FIG. 18, a top plate 32 includes a plurality of parallel reinforcement ribs 35 arranged in parallel at an angle of 45 degrees with respect to the widthwise direction of the top plate 32. The reinforcement ribs 35 each have a width w that is substantially equal to a distance D between the reinforcement ribs 35. The reinforcement ribs 35 each have a depth H of 8.8 mm, which is the same as that of the prior art (sample No. 1).

Figure 19:
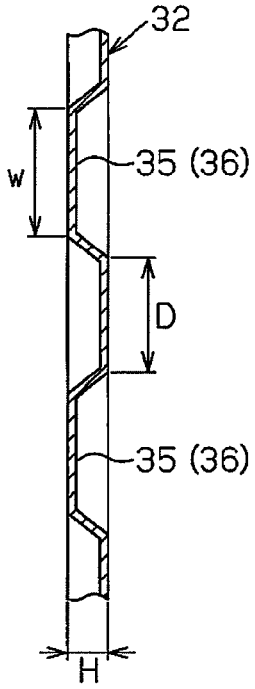
FIG. 19 is a partial cross-sectional view showing the cross-sectional shape of a reinforcement rib used in a sample top plate.

FIG. 19 shows the cross-sectional shape of each reinforcement rib used in the above sample top plates.

Tables 1 to 4 show results of the above analysis. Tables 1 and 2 show changes in the maximum deflection and the resonance rotation speed of the top plates resulting from the quantity of parallel reinforcement ribs (the depth H of each reinforcement rib is 8.8 mm) in each top plate. Tables 3 and 4 show changes in the maximum deflection and the resonance rotation speed of the top plates on which parallel reinforcement ribs and non-parallel reinforcement ribs are formed (the depth H of each reinforcement rib is 8.8 mm).

TABLE 1

| | Sample No. | | | | | | | |
|---|---|---|---|---|---|---|---|---|
| | 1 | 2 | 3 | 4 | 5 | 6 | 7 | 8 |
| w (mm) | 60.0 | 135.4 | 103.0 | 80.1 | 65.6 | 55.5 | 48.1 | 24.4 |
| w/W (%) | 7.5 | 16.9 | 12.8 | 10.0 | 8.2 | 6.9 | 6.0 | 5.3 |
| Plate Thickness (mm) | 0.8 | 0.7 | 0.7 | 0.7 | 0.7 | 0.7 | 0.7 | 0.7 |
| Maximum Deflection | 1.31 | 1.03 | 1.10 | 0.92 | 0.99 | 1.01 | 1.22 | 1.05 |
| Primary Resonance Rotation Speed (rpm) | 742.0 | 993.0 | 1000.0 | 1066.0 | 1065.0 | 1017.0 | 985.0 | 1030.0 |

TABLE 2

| | Sample No. | | | | | | | |
|---|---|---|---|---|---|---|---|---|
| | 1 | 2 | 3 | 4 | 5 | 6 | 7 | 8 |
| w (mm) | 60.0 | 135.4 | 103.0 | 80.1 | 65.6 | 55.5 | 48.1 | 24.4 |
| w/W (%) | 7.5 | 16.9 | 12.8 | 10.0 | 8.2 | 6.9 | 6.0 | 5.3 |
| Plate Thickness (mm) | 0.8 | 0.6 | 0.6 | 0.6 | 0.6 | 0.6 | 0.6 | 0.6 |
| Maximum Deflection | 1.31 | 1.47 | 1.47 | 1.17 | 1.28 | 1.28 | 1.57 | 1.31 |
| Primary Resonance Rotation Speed (rpm) | 742.0 | 836.0 | 840.0 | 913.0 | 931.0 | 870.0 | 865.0 | 908.0 |

TABLE 3

| | Sample No. | | | | | | |
|---|---|---|---|---|---|---|---|
| | 1 | 9 | 10 | 11 | 12 | 13 | 14 |
| w (mm) | 60.0 | 80.1 | 80.1 | 80.1 | 80.1 | 80.1 | 80.1 |
| w/W (%) | 7.5 | 10.0 | 10.0 | 10.0 | 10.0 | 10.0 | 10.0 |
| Plate Thickness (mm) | 0.8 | 0.7 | 0.7 | 0.7 | 0.7 | 0.7 | 0.7 |

TABLE 3-continued

| | Sample No. | | | | | | |
|---|---|---|---|---|---|---|---|
| | 1 | 9 | 10 | 11 | 12 | 13 | 14 |
| Maximum Deflection | 1.31 | 1.47 | 1.21 | 1.21 | 1.10 | 0.97 | 1.09 |
| Primary Resonance rotation speed (rpm) | 742.0 | 904.0 | 970.0 | 974.0 | 1000.0 | 1063.0 | 1022.0 |

TABLE 4

| | Sample No. | | | | | | |
|---|---|---|---|---|---|---|---|
| | 1 | 9 | 10 | 11 | 12 | 13 | 14 |
| w (mm) | 60.0 | 80.1 | 80.1 | 80.1 | 80.1 | 80.1 | 80.1 |
| w/W (%) | 7.5 | 10.0 | 10.0 | 10.0 | 10.0 | 10.0 | 10.0 |
| Plate Thickness (mm) | 0.8 | 0.6 | 0.6 | 0.6 | 0.6 | 0.6 | 0.6 |
| Maximum Deflection | 1.31 | 1.95 | 1.54 | 1.54 | 1.42 | 1.23 | 1.38 |
| Primary Resonance rotation speed (rpm) | 742.0 | 779.0 | 846.0 | 849.0 | 872.0 | 924.0 | 792.0 |

The analysis results shown in the tables above can be summarized as follows.

(a) The top plates 32 of sample Nos. 2 to 8 including the parallel reinforcement ribs 35 are ranked in the order of No. 4, No. 5, No. 6, No. 2, No. 8, No. 3, and No. 7 from the one having the highest rigidity. The top plate 32 of sample No. 4 including the five parallel reinforcement ribs 35 has the highest rigidity, and the top plate 32 of sample No. 7 including the eight parallel reinforcement ribs 35 has the lowest rigidity.

(b) The top plate 32 of the prior art example (sample No. 1), which includes the radial reinforcement ribs and the sub-reinforcement ribs, has a maximum deflection of 1.31 mm and a resonance rotation speed of 742.0 rpm when the plate thickness t is 0.8 mm. In comparison, among the top plates 32 of sample Nos. 2 to 8 including the parallel reinforcement ribs 35 and having the plate thickness t of 0.7 mm, the top plate 32 of sample No. 7 with the lowest rigidity has the maximum deflection of 1.22 mm and the resonance rotation speed of 985.0 rpm.

(c) The top plates 32 of sample Nos. 2 to 8 (having a plate thickness t reduced from 0.8 mm to 0.7 mm) including the parallel reinforcement ribs 35 have a smaller maximum deflection and a higher resonance rotation speed than the top plate 32 of the prior art example that includes the radial reinforcement ribs and the sub reinforcement ribs are arranged (sample No. 1). More specifically, the top plates 32 including the parallel reinforcement ribs 35, which are arranged in parallel, have remarkably improved rigidity and remarkably improved static characteristics as compared with the top plate 32 of the prior art example that includes the radial reinforcement ribs.

(d) The top plates 32 of sample Nos. 4, 5, and 6 (having a plate thickness t of 0.6 mm) on which the parallel reinforcement ribs 35 are arranged have a smaller maximum deflection and a higher resonance rotation speed than the top plate 32 of the prior art example (sample No. 1). More specifically, the top plates 32 of sample Nos. 4, 5, and 6 respectively have a maximum deflection reduced to 1.17 mm, 1.28 mm, and 1.28 mm and a resonance rotation speed increased to 913.0 rpm, 931.0 rpm, and 870.0 rpm. In short, the top plates 32 of sample Nos. 4, 5, 6, and 8 (having a plate thickness t of 0.6 mm) including the parallel reinforcement ribs 35 have a higher rigidity and more superior characteristics than the top plate 32 of the prior art example (having a plate thickness t of 0.8 mm) including the radial reinforcement ribs (sample No. 1).

As shown in Table 1, in the top plates 32 of sample Nos. 4, 5, 6, and 8, the width w of each reinforcement rib 35 is 10.0%, 8.2%, 6.9%, and 5.3% of the width W of the top plates 32, respectively.

(e) Among the top plates 32 (having a plate thickness t of 0.6 mm) on which the parallel reinforcement ribs 35 having the width w of 5.0%, 8.0%, 7.0%, and 10.0% of the width W of the top plates 32 are arranged at uniform intervals, the top plates 32 of sample Nos. 2 to 8 all have a smaller maximum deflection than the top plate 32 of the prior art example on which the radial reinforcement ribs and the sub reinforcement ribs are arranged (sample No. 1) when the plate thickness of the top plates 32 is 0.7 mm, and the top plates 32 of sample Nos. 4 to 6 and 8 have a smaller maximum deflection than the top plate 32 of the prior art example when the plate thickness of the top plates 32 is 0.6 mm.

(f) The cost of the top plate 32 is expected to be reduced through material cost reduction achieved by thinning the plate thickness of the top plate 32.

(g) The top plates 32 of sample Nos. 9 to 14 are ranked in the order of No. 13, No. 14, No. 12, No. 11, No. 10, and No. 9 from the one having the highest rigidity. This reveals that the rigidity of the top plate 32 depends greatly on the length of a reinforcement rib arranged in the vicinity of the middle portion of the top plate 32. For example, the top plate 32 of sample No. 13 including the long parallel reinforcement rib 35 near the middle portion of the top plate 32 has a smaller maximum deflection and a higher resonance rotation speed than the top plate 32 of sample No. 9 including the short reinforcement ribs near the middle portion of the top plate 32.

(h) The top plate 32 of the prior art example, which includes the radial reinforcement ribs and the sub-reinforcement ribs and has a plate thickness t of 0.8 mm (sample No. 1), has a maximum deflection of 1.31 mm and the resonance rotation speed of 742.0 rpm. In comparison, except for the top plate 32 of sample No. 9 having the lowest rigidity among the top plates 32 of sample Nos. 9 to 14, the top plates 32 of which plate thickness t is 0.7 mm have a smaller maximum deflection and a higher resonance rotation speed. This reveals that the top plates 32 of sample Nos. 10 to 14 that have a plate thickness t reduced from 0.8 mm to 0.7 mm also have higher rigidity and more superior static characteristics than the top plate 32 of the prior art example that includes the radial reinforcement ribs and the sub reinforcement ribs are arranged (sample No. 1).

(i) When comparing the top plate 32 of the prior art example (having a plate thickness t of 0.8 mm) including the radial reinforcement ribs and the sub reinforcement ribs (sample No. 1), the top plate 32 of sample No. 13 (having a plate thickness t of 0.6 mm) including the parallel reinforcement ribs 35 and the non-parallel reinforcement ribs 36 has a smaller maximum deflection of 1.23 mm and a higher resonance rotation speed of 924.0 rpm than the top plate 32 of the prior art example. In short, the top plate 32 of sample No. 13 including the parallel reinforcement ribs 35 and the non-parallel reinforcement ribs 36 have higher rigidity and more superior static characteristics than the top plate 32 of the prior art example including the radial reinforcement ribs (sample No. 1).

(j) When comparing the top plate 32 of the prior art example (having a plate thickness t of 0.8 mm) including the radial reinforcement ribs and the sub reinforcement ribs (sample No. 1), the plate thickness can be reduced by using the top plate 32 of sample No. 13 including the parallel reinforcement ribs 35 and the non-parallel reinforcement ribs 36 that are arranged at uniform intervals and have widths w that are 10.0% the width W of the top plate 32.

(k) The cost of the top plate 32 is expected to be reduced since the material cost is reduced to the decreased plate thickness.

(l) When the top plates 32 include the parallel reinforcement ribs 35 and the non-parallel reinforcement ribs 36, the possibility of warping occurring is decreased when pressing and forming the parallel reinforcement ribs 35 and the non-parallel reinforcement ribs 36.

Third Embodiment

Figure 20:
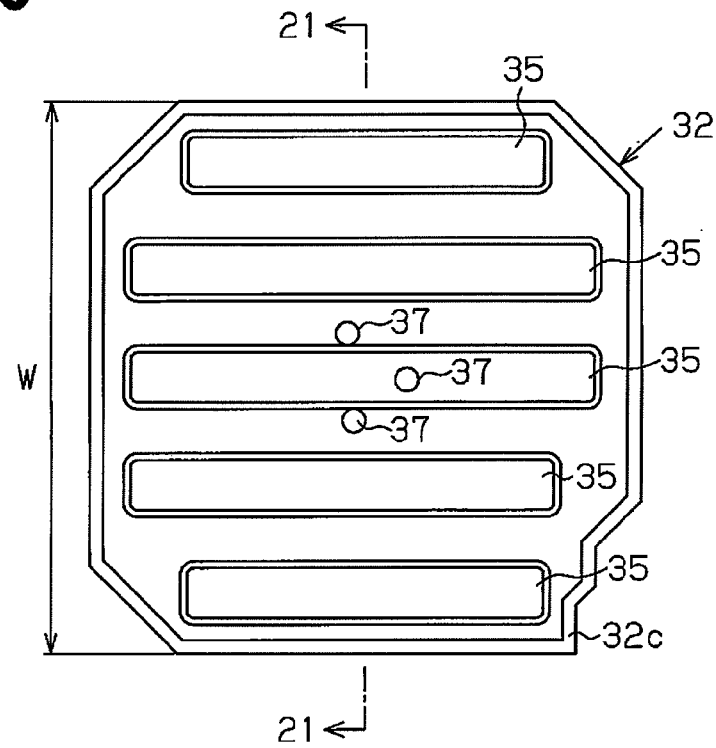
FIG. 20 is a bottom view showing a top plate structure for an air conditioner for installation at a high location according to a third embodiment.
Figure 21:
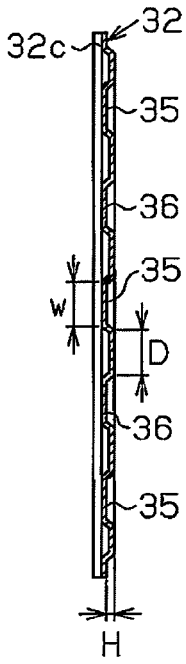
FIG. 21 is a cross-sectional view taken along line 21-21 of FIG. 20.

FIGS. 20 and 21 show a top plate structure for an air conditioner for installation at a high location according to a third embodiment of the present invention.

In this case, in the same manner as the first embodiment, a top plate 32 is formed to be optimal for application to a body casing 3 for a ceiling concealed air conditioner (indoor unit) that is the same as that of the prior art example described and illustrated in FIGS. 41 to 43.

The top plate 32 has a plate thickness t of about 0.6 mm and is thinner than the prior art top plate (0.8 mm) and is formed to have a substantially hexagonal shape in correspondence with the shape of the cassette body casing 3 included in the ceiling concealed air conditioner as shown in FIG. 20. A hook-shaped rim portion 32*c* is formed along the periphery of the top plate 32 to fit the top plate 32 to the periphery of an upper end portion of a heat insulating member 3*a* (refer to FIG. 41), which forms the side wall of the body casing 3.

The top plate 32 includes five parallel reinforcement ribs 35 arranged in parallel in the widthwise W direction of the top plate 32 as shown in FIG. 20 and flat portions formed between the parallel reinforcement ribs 35. Each parallel reinforcement rib 35 has a trapezoidal cross-section. Each reinforcement rib 35 has a width w that is substantially equal to the distance D between two reinforcement ribs 35 and a depth H of 7 to 11 mm. The width w of each reinforcement rib 35 is preferably 5 to 15% of the width W of the top plate 32, and more preferably 10% of the width W. When this is set to less than 5%, an excessively large number of reinforcement ribs must be formed thereby making the reinforcement ribs difficult to form. If this is set to more than 15%, there will not be enough reinforcement ribs and the effect of the reinforcement ribs will become insufficient. The top plate 32 includes fan motor attachment portions 37.

With the above-described structure, when the plate thickness is the same as that of the prior art top plate, compared to the prior art top plate in which the top plate 32 includes the radial reinforcement ribs, the top plate 32 including the parallel reinforcement ribs 35 has a smaller maximum deflection and a higher resonance rotation speed. This improves the static characteristics of the air conditioner when installed at a high location. Further, even if the top plate 32 has a smaller plate thickness than the prior art top plate, by optimally adjusting the quantity and width of the reinforcement ribs 35, the maximum deflection is lowered and the resonance rotation speed is improved compared to the prior art top plate. Thus, the cost of the top plate 32 can be expected to be reduced by reduction in material cost. Further, the top plate 32 has a higher primary natural vibration frequency. This makes it easy to take measures for preventing noise that would be generated when the top plate 32 vibrates as the fan motor 9 produces rotation. Further, in the present embodiment, by setting the depth H of each reinforcement rib 35 in the range of 7 to 11 mm, the maximum deflection is decreased, the resonance rotation speed is increased, and the cost of the top plate can be expected to be reduced due to the reduction in material cost. The maximum deflection becomes lower and the resonance rotation speed becomes higher as the depth of the reinforcement ribs 35 increases. However, to satisfy design standards, it is preferred that the upper limit of the depth for the reinforcement ribs 35 be 11 mm.

To verify the effects described above, or the influence the depth H of the reinforcement ribs 35 has on the behavior of the top plate 32, a plurality of top plates having reinforcement ribs 35 with different depths H were prepared, and the maximum deflection (static characteristics) and the resonance rotation speed (dynamic characteristics) of each sample plate were analyzed (FEM analysis).

In this analysis, the depth H of the reinforcement ribs 35 is varied throughout the range of 2.0 to 18.0 mm. More specifically, based on a top plate including reinforcement ribs 35 having a depth H of 6.0 mm and arranged in a manner that the width w of the reinforcement ribs 35 is substantially equal to the distance D, cases in which the depth H is varied are analyzed. The depth H is varied while the width w of the reinforcement ribs is kept fixed. In this case, the distance D decreases as the depth H increases.

Figure 22:
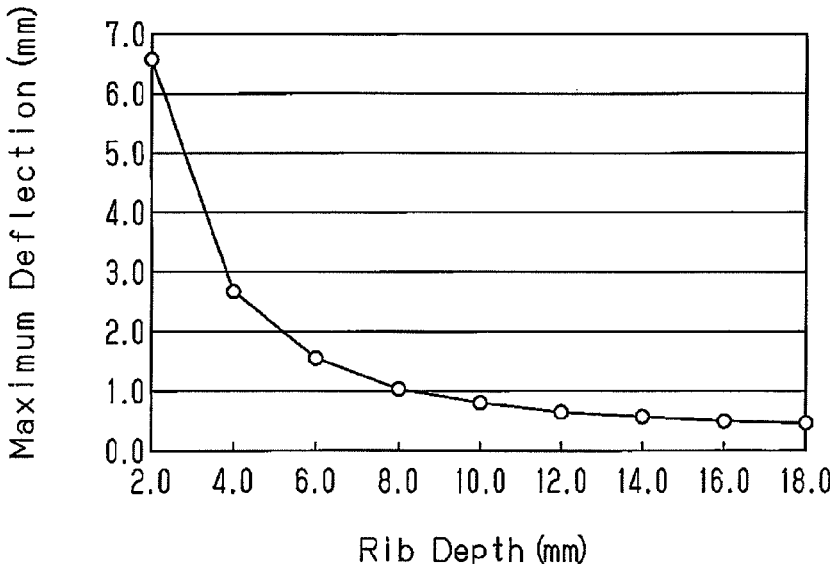
FIG. 22 is a characteristic diagram showing the relationship between the depth of a reinforcement rib used in the top plate structure for an air conditioner of the third embodiment and the maximum deflection of a top plate.
Figure 23:
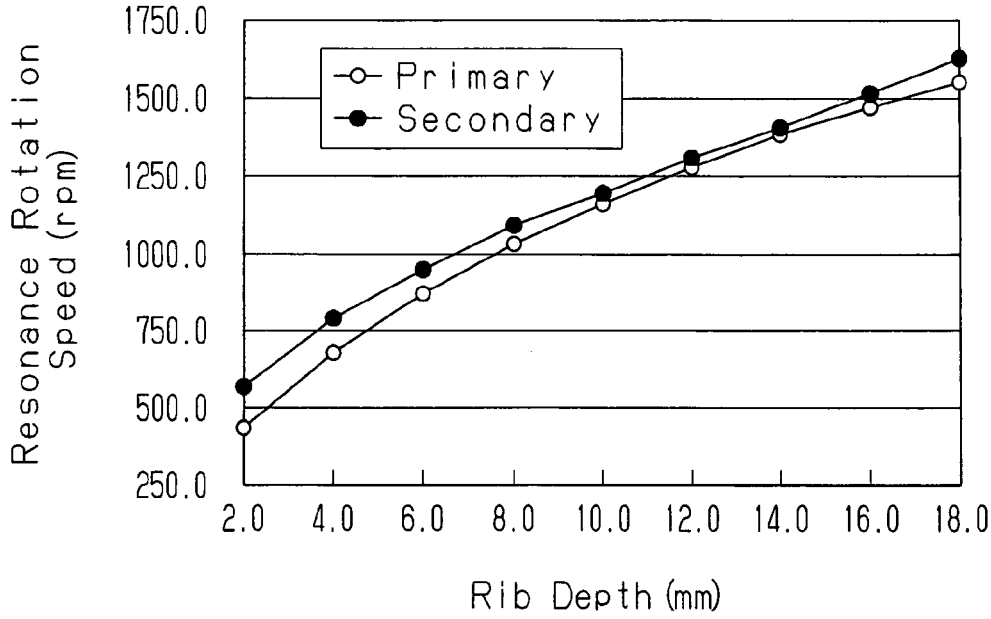
FIG. 23 is a characteristic diagram showing the relationship between the depth of a reinforcement rib used in the top plate structure for the air conditioner of the third embodiment and the resonance rotation speed of the top plate.

Under the above analysis conditions, the maximum deflection and the resonance rotation speed of the top plates were analyzed using I-DEAS MS9m2 Model Solution. Table 5 and FIGS. 22 and 23 show the analysis results.

TABLE 5

| Rib Specifications | Prior Art Type | Parallel Rib | | | | | | | | |
|---|---|---|---|---|---|---|---|---|---|---|
| Plate Thickness t (mm) | 0.8 | 0.7 | | | | | | | | |
| Width w (mm) | 60.0 | 74.4 | 74.4 | 74.4 | 74.4 | 74.4 | 74.4 | 74.4 | 74.4 | 74.4 |
| Distance D | — | 82.5 | 78.5 | 74.5 | 70.5 | 66.5 | 62.5 | 58.5 | 54.5 | 50.5 |
| Depth H | 8.8 | 2.0 | 4.0 | 6.0 | 8.0 | 10.0 | 12.0 | 14.0 | 16.0 | 18.0 |
| Maximum Deflection (mm) | 1.31 | 6.55 | 2.60 | 1.50 | 1.03 | 0.78 | 0.63 | 0.53 | 0.45 | 0.41 |
| Primary Resonance Rotation Speed (rpm) | 742.0 | 426.0 | 665.0 | 859.0 | 1017.0 | 1151.0 | 1273.0 | 1378.0 | 1465.0 | 1535.0 |
| Secondary Resonance Rotation Speed (rpm) | — | 556.0 | 774.0 | 942.0 | 1078.0 | 1189.0 | 1291.0 | 1393.0 | 1504.0 | 1616.0 |

Note:
W = 802.0 mm

The analysis results shown in Table 5 and FIGS. 22 and 23 will be summarized as follows.

(a) The top plates 32 including the parallel reinforcement ribs 35 have better static characteristics as the depth H of the reinforcement ribs 35 increases. More specifically, by increasing the depth H of the reinforcement ribs 35, the maximum deflection of the top plate decreases and the resonance rotation speed of the top plate increases.

(b) As shown in FIGS. 22 and 23, the depth H of the reinforcement ribs 35 has a great influence on the maximum deflection and the resonance rotation speed of the top plate when the depth H is 2.0 to 6.0 mm and relatively small. This reveals that when the depth H of the reinforcement ribs 35 is relatively small, a small change (or variation) in the depth H of each reinforcement rib 35 translates into a great change in the maximum deflection and the resonance rotation speed of the top plate. Thus, the robustness of the static characteristics of the top plate against the depth H of each reinforcement rib 35 is low. For example, when increasing the depth H of each reinforcement rib 35 from 2.0 mm to 4.0 mm, the maximum deflection is lowered by 60.3% from 6.55 mm to 2.60 mm. Further, the resonance rotation speed is increased by 56.1% from 426.0 rpm to 665.0 rpm.

(c) As apparent in FIGS. 22 and 23, the depth H of the reinforcement ribs 35 has a small influence on the maximum deflection and the resonance rotation speed of the top plate when the depth H is 8.0 to 12.0 mm and relatively large. This reveals that a small change (or variation) in the depth H of each reinforcement rib 35 does not translate into a great change in the maximum deflection and the resonance rotation speed of the top plate. Thus, the robustness of the static characteristics of the top plate against the depth H of each reinforcement rib 35 is relatively high. For example, when increasing the depth H of each reinforcement rib 35 from 10.0 mm to 12.0 mm, the maximum deflection is decreased by 19.2% from 0.78 mm to 0.63 mm, and the resonance rotation speed is increased by 10.6% from 1151.0 rpm to 1273.0 rpm.

(d) Further, as shown in FIGS. 22 and 23, the depth H of each reinforcement rib 35 has only a limited influence on the maximum deflection and the resonance rotation speed of the top plate when the depth H of each reinforcement rib 35 is 14.0 to 18.0 mm and relatively large. This reveals that a small change (or variation) in the depth H of each reinforcement rib 35 translates into only a small change in the maximum deflection and the resonance rotation speed of the top plate. Thus, the robustness of the static characteristics of the top plate against the depth H of each reinforcement rib 35 is high when the depth H is large. For example, when increasing the depth H of each reinforcement rib 35 from 14.0 mm to 16.0 mm, the maximum deflection is decreased by only 15.1% from 0.53 mm to 0.45 mm, and the resonance rotation speed is increased by only 6.3% from 1378.0 rpm to 1465.0 rpm.

(e) In the prior art, the design standard requires the maximum deflection of the top plate to be suppressed to 1.31 mm or lower and the resonance rotation speed of the top plate must be maintained at 742.0 rpm or higher. To satisfy this design standard and to maintain the robustness of the static characteristics of the top plate against the depth H of the reinforcement ribs 35, it is believed that the most preferable range of the depth H of the reinforcement ribs 35 is 7.0 to 11.0 mm.

Figure 24A:
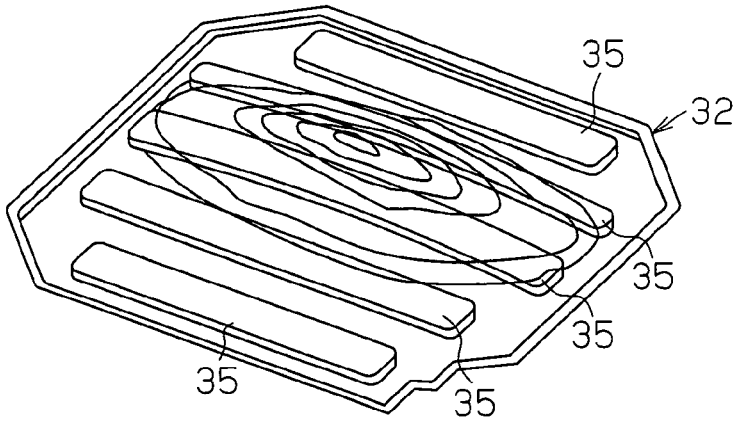
FIG. 24 shows natural vibration modes of the top plate structure for the air conditioner of the third embodiment, where FIG. 24(*a*) shows a primary mode and FIG. 24(*b*) shows a secondary mode.
Figure 24B:
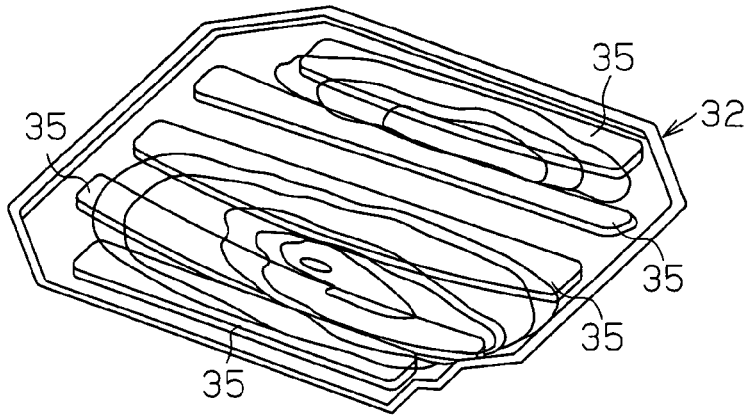

(f) When taking into consideration the weight of components attached to the top plate, it is apparent that natural vibration modes (natural vibration frequency=resonance rotation speed/60) of the top plate switch at the point where the depth H of each reinforcement rib 35 is 13.0 mm. FIGS. 24(*a*) and 24(*b*) show primary and secondary natural vibration modes of the top plate (the depth H of each reinforcement rib 35 is 8.0 mm). In the primary mode, a fan motor attachment portion of the top plate vertically vibrates greatly as shown in FIG. 24(*a*). In the secondary mode, the fan motor attachment portions are located near a node of the mode and its vibrations are suppressed to a certain degree as shown in FIG. 24 (*b*). This reveals that the secondary mode is a mode in which it is difficult for the force of the vibrations added by the fan motor to result in excitation. Thus, the switching of the natural vibration modes of the top plate by increasing the depth H of the reinforcement ribs 35 is assumed to contribute to reducing vibrations of the top plate and to making the indoor unit quiet.

(g) The above analysis reveals that by appropriately combining the quantity, length, and depth of the reinforcement ribs 35, and the distance between the reinforcement ribs 35 as design parameters, it is believed that the fan motor attachment portions can be located at nodes of a natural vibration mode of the top plate. As a result, the vibrations of the top plate will not be excited or will be less likely to be excited by force of the vibrations added by the fan motor. This significantly reduces the noise of the indoor unit.

Fourth Embodiment

Figure 25:
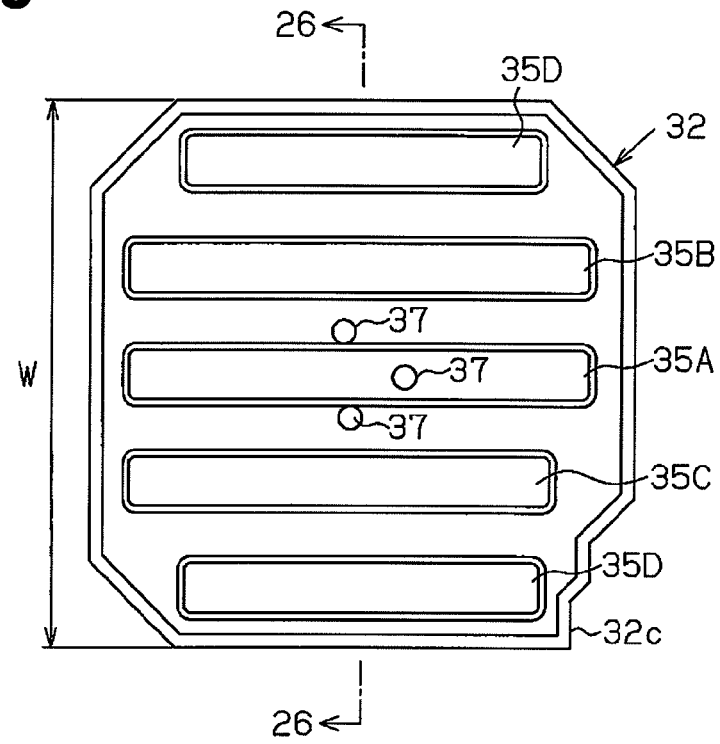
FIG. 25 is a bottom view showing a top plate structure for an air conditioner according to a fourth embodiment.
Figure 26:
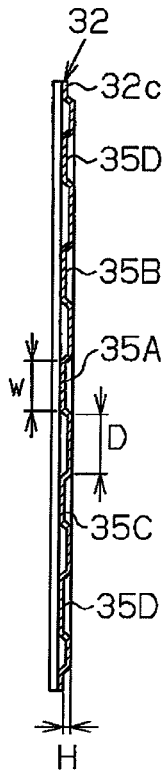
FIG. 26 is a cross-sectional view taken along line 26-26 of FIG. 25.

FIGS. 25 and 26 show a top plate structure for an air conditioner for installation at a high location according to a fourth embodiment of the present invention.

In this case, in the same manner as the first embodiment, a top plate 32 is formed to be optimal for application to a body casing 3 for an air conditioner (indoor unit) that is the same as that of the prior art example illustrated in FIGS. 41 to 43.

The top plate 32 has a plate thickness t of about 0.6 mm and is thinner than the prior art top plate (0.8 mm) and is formed to have a substantially hexagonal shape in correspondence with the shape of the cassette body casing 3 included in the ceiling concealed air conditioner as shown in FIG. 25. A hook-shaped rim portion 32*c* is formed along the periphery of the top plate 32 to fit the top plate 32 to the periphery of an upper end portion of a heat insulating member 3*a* (refer to FIG. 41).

The top plate 32 includes five parallel reinforcement ribs 35A to 35D arranged in parallel in the widthwise W direction of the top plate 32 as shown in FIG. 25 and flat portions formed between the parallel reinforcement ribs 35A to 35D. The parallel reinforcement ribs 35A to 35D each have a trapezoidal cross-section. Further, the reinforcement ribs 35A to 35D have different depths H. Each reinforcement rib 35 has a width w that is preferably 5 to 15% of the width W of the top plate 32, and more preferably 10% of the width W. When this is set to less than 5%, an excessively large number of reinforcement ribs must be formed thereby making the reinforcement ribs difficult to form. If this is set to more than 15%, there will not be enough reinforcement ribs and the effect of the reinforcement ribs will become insufficient. Reference numeral 37 denotes fan motor attachment portions.

With the above-described structure, when the plate thickness is the same as that of the prior art top plate, compared to the prior art top plate in which the top plate 32 includes the radial reinforcement ribs, the top plate 32 including the parallel reinforcement ribs 35A to 35D has a smaller maximum deflection and a higher resonance rotation speed. This improves the static characteristics of the air conditioner. Further, even if the top plate 32 has a smaller plate thickness than the prior art top plate, by optimally adjusting the quantity and width of the reinforcement ribs 35A to 35D, the maximum deflection is lowered and the resonance rotation speed is improved compared to the prior art top plate. Thus, the cost of the top plate 32 can be expected to be reduced by reduction in material cost. Further, the top plate 32 has a higher primary natural vibration frequency. This makes it easy to take measures for preventing noise that would be generated when the top plate 32 vibrates as the fan motor 9 produces rotation. Further, in the present embodiment, by setting the depth H of the reinforcement ribs 35A to 35D in the range of 7 to 11 mm, the maximum deflection is decreased, the resonance rotation speed is increased, and the cost of the top plate can be expected to be reduced due to the reduction in material cost. The depth H of the reinforcement rib 35A located in the middle may differ from the depth H of each of the other reinforcement ribs 35B to 35D.

To verify the effects described above (the influence of the different depths H of the reinforcement ribs 35A to 35D on the behavior of the top plate 32), top plates including reinforcement ribs 35A to 35D with different depths H were prepared, and the maximum deflection (static characteristics) and resonance rotation speed (dynamic characteristics) of each sample plate were analyzed (FEM analysis).

This analysis was performed to check the influence the depth of the reinforcement ribs has on static characteristics of the top plates when using the depths of the reinforcement ribs 35A to 35D as four design variables (parameters or factors). In the analysis, the depth of the reinforcement ribs 35A to 35D is set at three levels (6.0 mm, 8.0 mm, and 10.0 mm). When all possible cases are established by combining the design parameters, analyses of $3^4$=81 are required to be performed. However, these combinations are applied to an L9 orthogonal array of quality engineering shown in Table 6 to enable evaluation with nine analyses. By using the quality engineering orthogonal array, only a small number of analyses are required to be performed to obtain analysis results similar to the results obtained by performing all of the analyses.

TABLE 6

| Analysis | Design Variables (Depth of Ribs A to D (mm)) | | | |
|---|---|---|---|---|
| Case | A | B | C | D |
| 1 | 6.0 | 6.0 | 6.0 | 6.0 |
| 2 | 6.0 | 8.0 | 8.0 | 8.0 |
| 3 | 6.0 | 10.0 | 10.0 | 10.0 |
| 4 | 8.0 | 6.0 | 8.0 | 10.0 |
| 5 | 8.0 | 8.0 | 10.0 | 6.0 |
| 6 | 8.0 | 10.0 | 6.0 | 8.0 |
| 7 | 10.0 | 6.0 | 10.0 | 6.0 |
| 8 | 10.0 | 8.0 | 6.0 | 10.0 |
| 9 | 10.0 | 10.0 | 8.0 | 6.0 |

Figure 27:
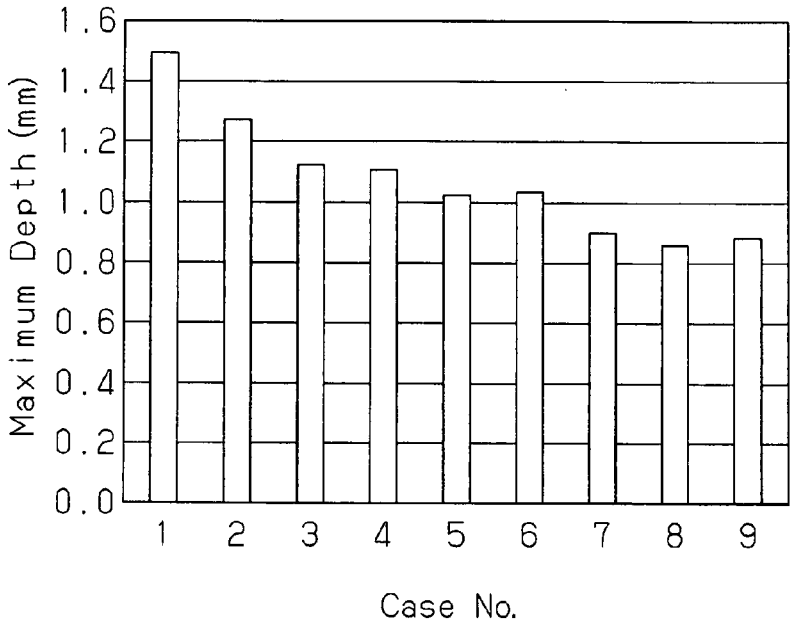
FIG. 27 is a characteristic diagram showing the relationship between each of the analysis cases set by combining various values of the depth of reinforcement ribs in the top plate structure for the air conditioner of the fourth embodiment and the maximum deflection of the top plate of the fourth embodiment.
Figure 28:
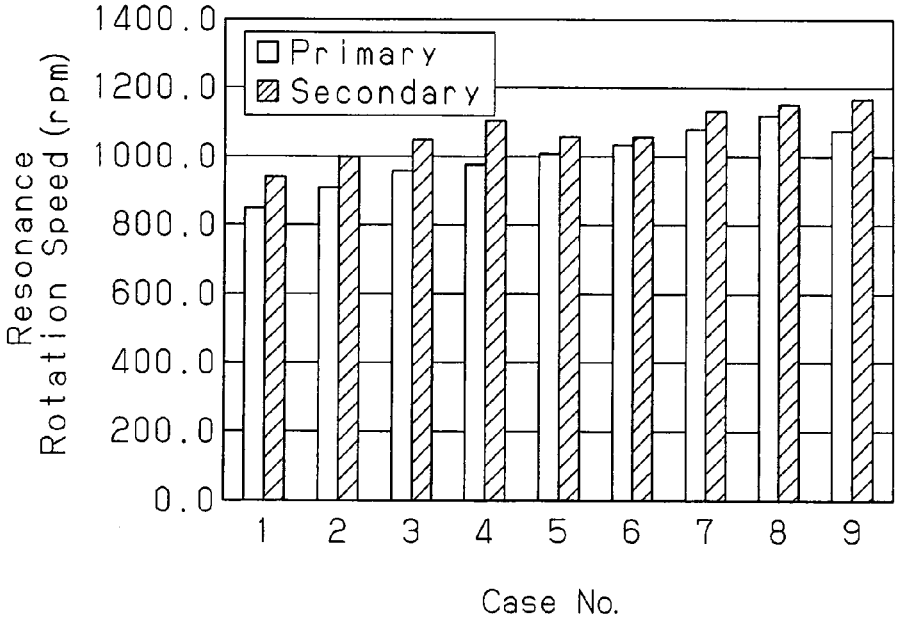
FIG. 28 is a characteristic diagram showing the relationship between each of the analysis cases set by combining various values of the depth of reinforcement ribs in the top plate structure for the air conditioner according to the fourth embodiment and the resonance rotation speed of the top plate of the fourth embodiment.

Table 7 and FIGS. 27 and 28 show the analysis results.

TABLE 7

| | Analysis Case | | | | | | | | |
|---|---|---|---|---|---|---|---|---|---|
| | 1 | 2 | 3 | 4 | 5 | 6 | 7 | 8 | 9 |
| Maximum Deflection (mm) | 1.50 | 1.28 | 1.13 | 1.11 | 1.03 | 1.04 | 0.90 | 0.86 | 0.88 |
| Primary Resonance Rotation Speed (rpm) | 859.0 | 909.0 | 943.0 | 975.0 | 1013.0 | 1043.0 | 1082.0 | 1122.0 | 1079.0 |
| Secondary Resonance Rotation Speed (rpm) | 942.0 | 998.0 | 1050.0 | 1105.0 | 1058.0 | 1065.0 | 1146.0 | 1167.0 | 1181.0 |

Figure 29:
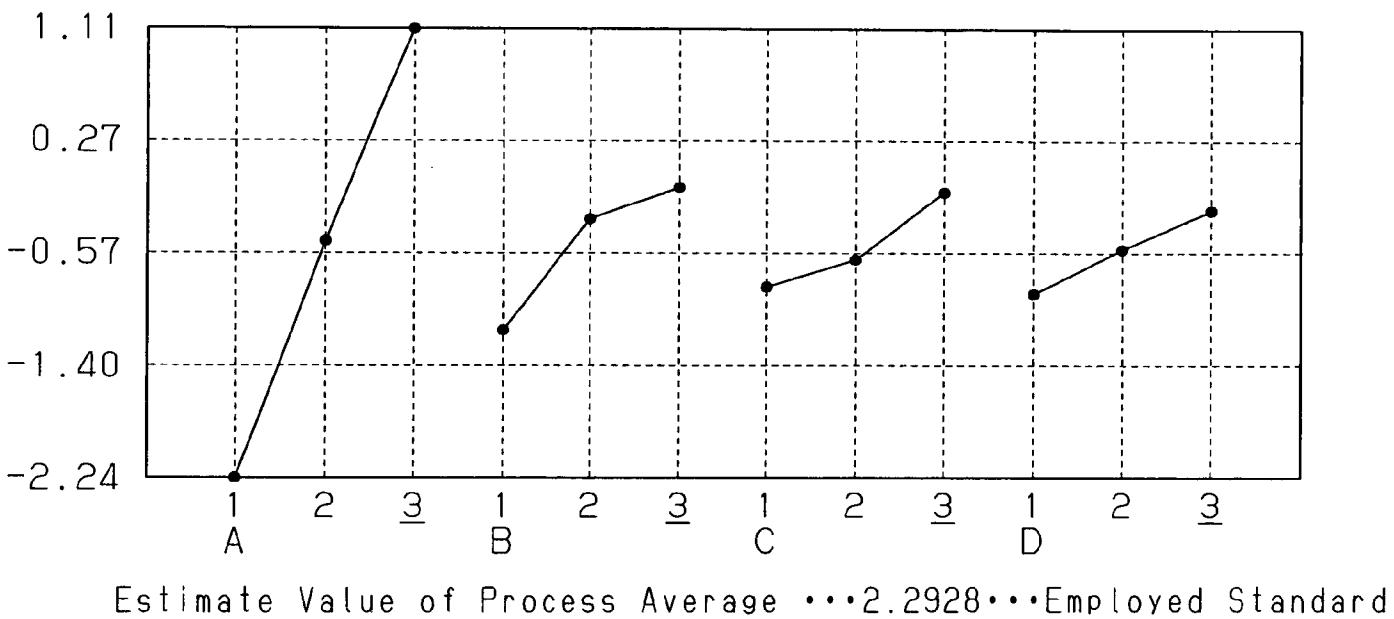
FIG. 29 is a diagram showing the factorial effects of the maximum deflection on the top plate structure for the air conditioner of the fourth embodiment.
Figure 30:
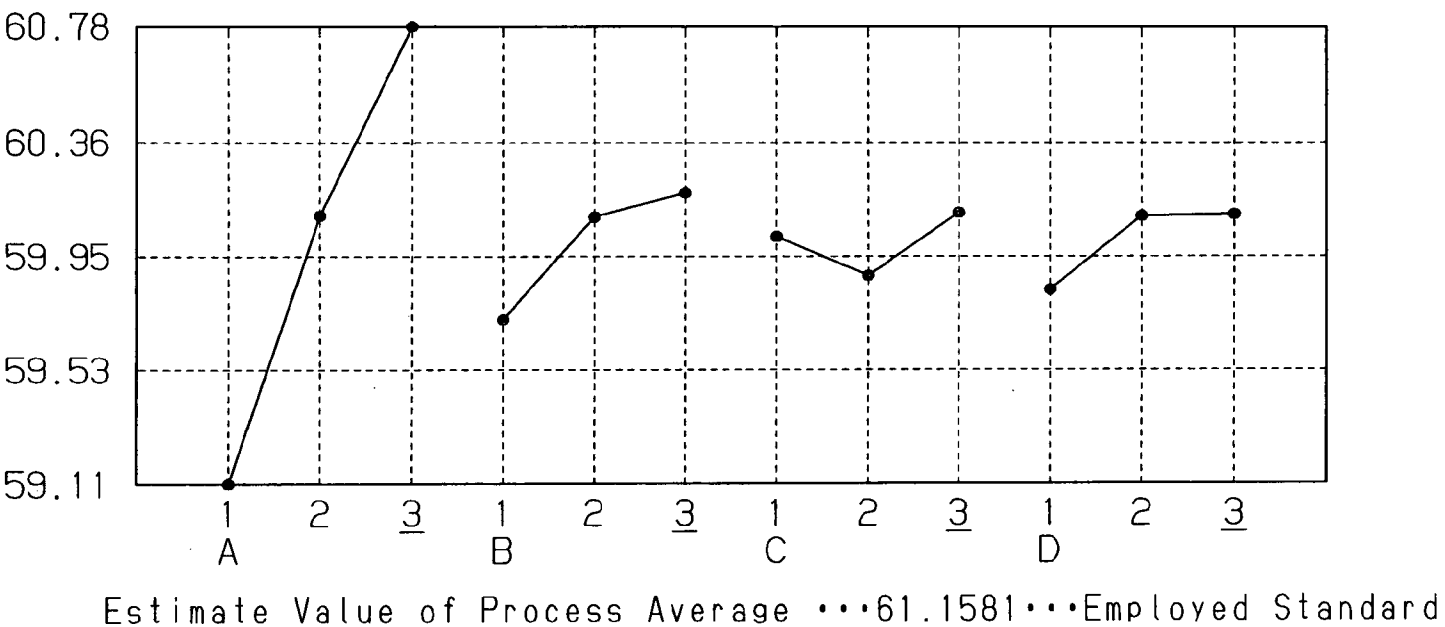
FIG. 30 is a diagram showing factorial effects of the primary resonance rotation speed on the top plate structure for the air conditioner of the fourth embodiment.
Figure 31:
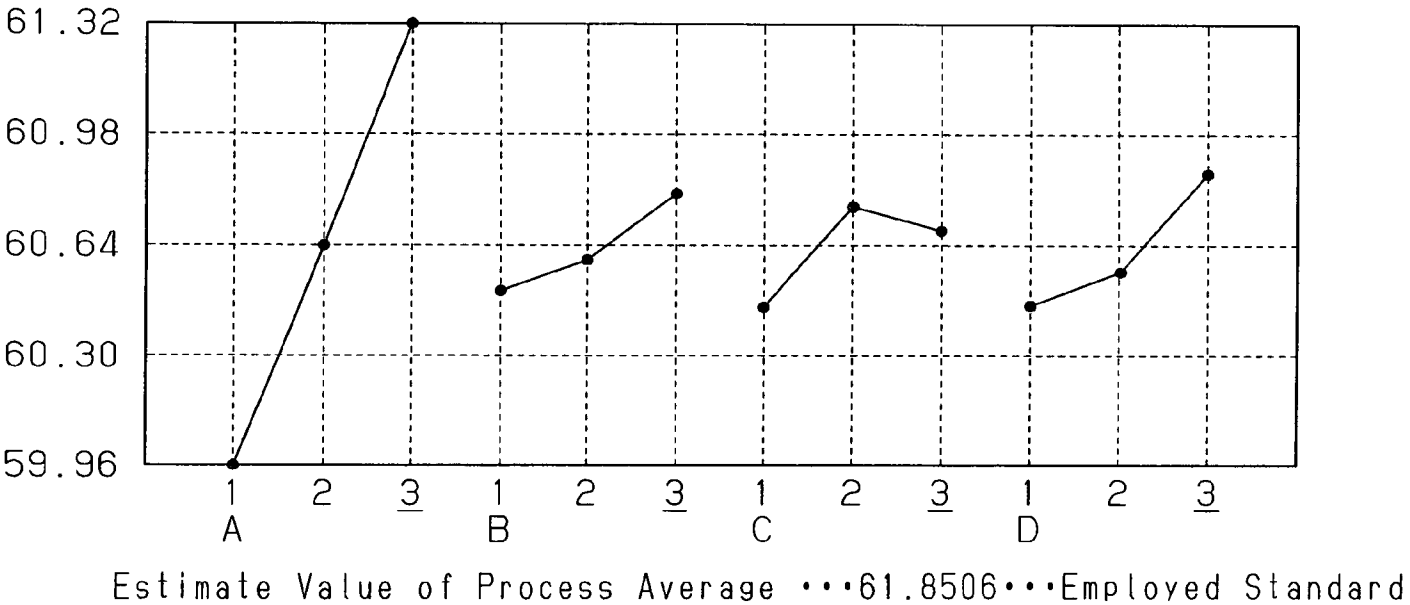
FIG. 31 is a diagram showing factorial effects of the secondary resonance rotation speed on the top plate structure for the air conditioner of the fourth embodiment.
Figure 32:
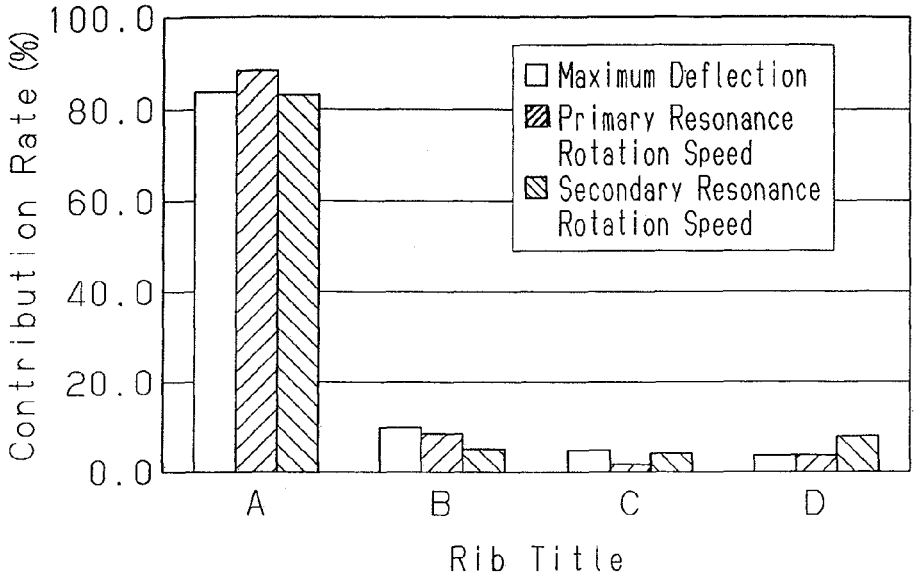
FIG. 32 is a characteristic diagram showing the contribution rate of reinforcement ribs in the top plate structure for the air conditioner of the fourth embodiment to the maximum deflection and the resonance rotation speed of the top plate of the fourth embodiment.

FIGS. 29 to 31 show optimum combinations (factorial effects) of the depth of the reinforcement ribs, and Table 8 and FIG. 32 show the rate at which the reinforcement ribs 35A to 35D contribute to the maximum deflection and the resonance rotation speed. Secondary Resonance Rotation Speed (rpm)

TABLE 8

| Rib Title | A | B | C | D |
|---|---|---|---|---|
| Contribution Rate to Maximum Deflection (%) | 83.37 | 9.26 | 4.04 | 3.33 |
| Contribution Rate to Primary Resonance Rotation Speed (%) | 87.94 | 7.50 | 1.63 | 2.93 |
| Contribution Rate to Secondary Resonance Rotation Speed (%) | 83.16 | 4.06 | 4.74 | 8.03 |

The analysis results shown in Tables 7 and 8 and FIGS. 27 to 32 will be summarized as follows.

(a) As shown in FIG. 29, when the reinforcement ribs 35A to 35D all have a depth of level 3 (10.0 mm), the top plate has a small maximum deflection. More specifically, the maximum deflection becomes lower as the depth of the reinforcement ribs 35A to 35D increases. The reinforcement ribs 35A to 35D have different degrees of influence on the maximum deflection. As shown in Table 8 and FIG. 32, the reinforcement rib 35A has a remarkably high contribution rate of 83.37%, whereas the reinforcement ribs 35B to 35D have a contribution rate of only 16.63% in total. This reveals that more than 80% of the maximum deflection of the top plate is determined by the reinforcement rib 35A.

(b) As shown in FIG. 30, the primary resonance rotation speed is increased in all cases when the reinforcement ribs 35B to 35D have a depth of level 3 (10.0 mm). As shown in Table 8 and FIG. 32, the reinforcement rib 35A has a remarkably high contribution rate of 87.94%, whereas the reinforcement ribs 35B to 35D have a contribution rate of only 12.06% in total. The secondary resonance rotation speed is increased when the reinforcement rib 35C has a depth of level 2 (8.0 mm). However, the reinforcement rib 35C has a contribution rate of only 4.74%. The reinforcement rib 35A has a remarkably high contribution rate of 83.16% in this case as well.

(c) In the top plate including the parallel reinforcement ribs, the reinforcement rib 35A located in the middle has the greatest influence on the maximum deflection and the resonance rotation speed. The contribution rate of the reinforcement rib 35A to the maximum deflection and the resonance rotation speed is more than 80%.

Fifth Embodiment

Figure 33:
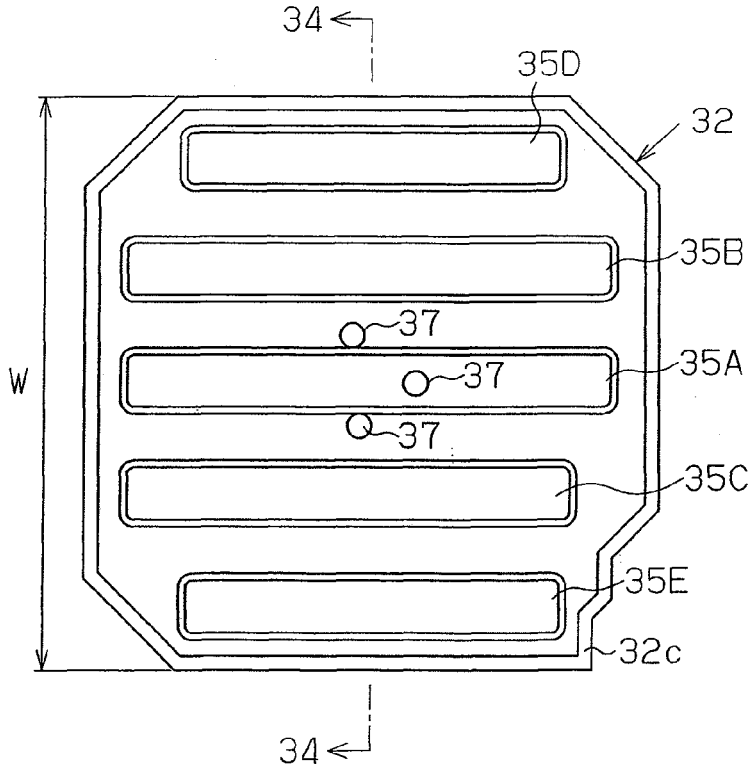
FIG. 33 is a bottom view showing a top plate structure for an air conditioner according to a fifth embodiment.
Figure 34:
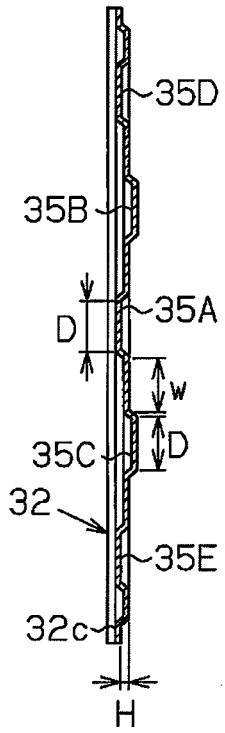
FIG. 34 is a cross-sectional view taken along line 34-34 of FIG. 33.

FIGS. 33 and 34 show a top plate structure for an air conditioner installed at a high location according to a fifth embodiment of the present invention.

In this case, in the same manner as the first embodiment, a top plate 32 is formed to be optimal for application to a body casing 3 for an air conditioner (indoor unit) that is the same as that of the prior art example illustrated in FIGS. 41 to 43.

The top plate 32 has a plate thickness t of about 0.6 mm and is thinner than the prior art top plate (0.8 mm) and is formed to have a substantially hexagonal shape in correspondence with the shape of the cassette body casing 3 included in the ceiling concealed air conditioner as shown in FIG. 33. A hook-shaped rim portion 32*c* is formed along the periphery of the top plate 32 to fit the top plate 32 to the periphery of an upper end portion of a heat insulating member 3*a* (refer to FIG. 41), which forms the side wall of the body casing 3.

The top plate 32 includes five parallel reinforcement ribs 35A to 35E arranged in parallel in the widthwise W direction of the top plate 32 as shown in FIG. 33 and flat portions formed between the parallel reinforcement ribs 35A to 35E. The parallel reinforcement ribs 35A to 35E each have a trapezoidal cross-section and project alternately from the front side or rear side of the top plate. This further lowers the maximum deflection, and the cost of the top plate can be expected to be reduced due to reduction in material cost. Each reinforcement rib 35 has a width w that is preferably 5 to 15% of the width W of the top plate 32, and more preferably 10% of the width W. When this is set to less than 5%, an excessively large number of reinforcement ribs must be formed thereby making the reinforcement ribs difficult to form. If this is set to more than 15%, there will not be enough reinforcement ribs and the effect of the reinforcement ribs will become insufficient. Reference numeral 37 denotes fan motor attachment portions.

With the above-described structure, when the plate thickness is the same as that of the prior art top plate, compared to the prior art top plate in which the top plate 32 includes the radial reinforcement ribs, the top plate 32 including the parallel reinforcement ribs 35A to 35E has a smaller maximum deflection and a higher resonance rotation speed. This improves the static characteristics of the air conditioner when installed at a high location. Further, even if the top plate 32 has a smaller plate thickness than the prior art top plate, by optimally adjusting the quantity and width of the reinforcement ribs 35A to 35E, the maximum deflection is lowered and the resonance rotation speed is improved compared to the prior art top plate. Thus, the cost of the top plate 32 can be expected to be reduced by reduction in material cost. Further, the top plate 32 has a higher primary natural vibration frequency. This makes it easy to take measures for preventing noise that would be generated when the top plate 32 vibrates as the fan motor 9 produces rotation.

Further, in the present embodiment, by setting the depth H of the reinforcement ribs 35A to 35D in the range of 7 to 11 mm, the maximum deflection is decreased, the resonance rotation speed is increased, and the cost of the top plate can be expected to be reduced due to the reduction in material cost. The maximum deflection decreases and the resonance rotation speed increases as the depth of each reinforcement rib increases. However, to satisfy the design standard, it is preferred that the upper limit of the depth of each reinforcement rib be 11 mm.

The reinforcement ribs 35A to 35E may have different depths H. This would lower the maximum deflection and increase the resonance rotation speed, and the cost of the top plate can expected to be reduced due to reduction in material cost. The depth H of the reinforcement rib 35A located in the middle may differ from the depths H of the other reinforcement ribs 35B to 35E.

To verify the effects described above, or more specifically, the influence the reinforcement ribs 35A to 35E have on the behavior of the top plate 32, a plurality of top plates including reinforcement ribs 35A to 35D projecting alternately from the front side and rear side were prepared, and the maximum deflection (static characteristics) and the resonance rotation speed (dynamic characteristics) of each top plate were analyzed.

Figure 35:
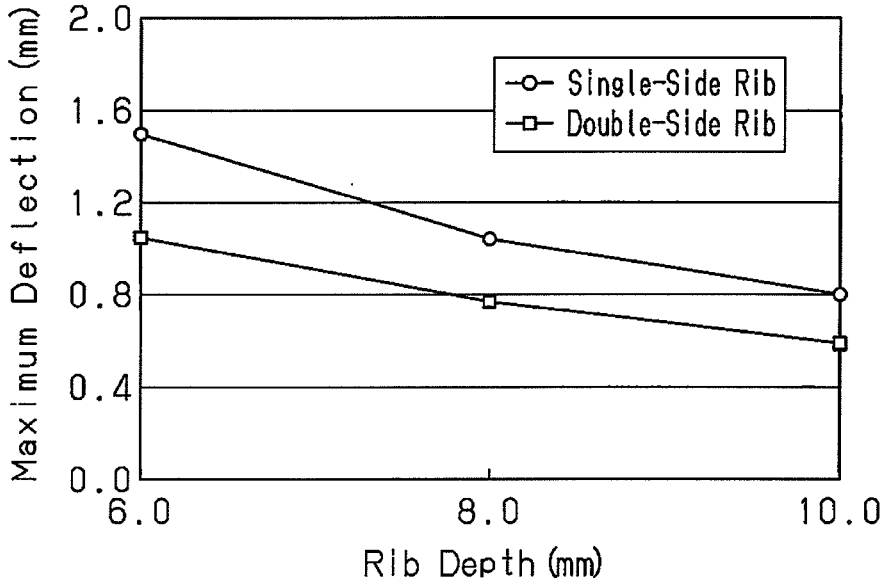
FIG. 35 is a characteristic diagram showing the relationship between the depth of each reinforcement rib in the top plate structure for the air conditioner of the fifth embodiment and the maximum deflection of the top plate.
Figure 36:
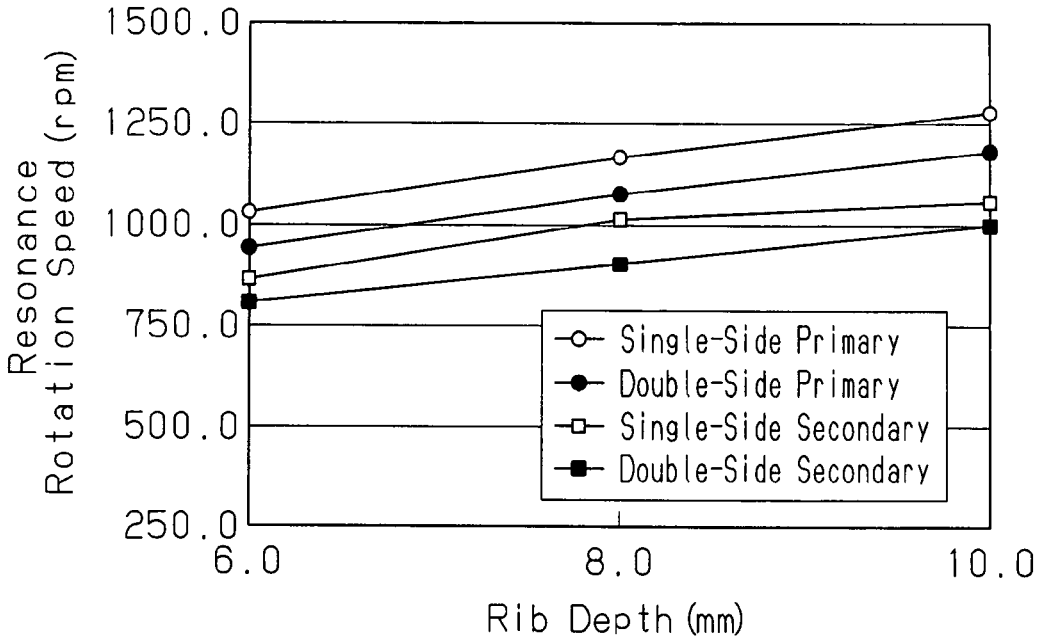
FIG. 36 is a characteristic diagram showing the relationship between the depth of each reinforcement rib in the top plate structure for the air conditioner of the fifth embodiment and the resonance rotation speed of the top plate.

In this analysis (FEM analysis), the depth H of the reinforcement ribs 35A to 35E was varied in a thorough manner at 6.0 mm, 8.0 mm, and 10.0 mm. Top plates including reinforcement ribs formed on one sides and top plates including reinforcement ribs formed on two sides were compared and analyzed. Table 9 and FIGS. 35 and 36 show the analysis results.

TABLE 9

| Rib Depth (mm) | Maximum Deflection (mm) | | Resonance Rotation Speed (rpm) | | | |
|---|---|---|---|---|---|---|
| | | | Primary | | Secondary | |
| | One Side | Two Sides | Two Sides | One Side | Two Sides | One Side |
| 6.0 | 1.04 | 1.50 | 806.0 | 859.0 | 1014.0 | 942.0 |
| 8.0 | 0.75 | 1.03 | 909.0 | 1017.0 | 1169.0 | 1078.0 |
| 10.0 | 0.59 | 0.78 | 1009.0 | 1066.0 | 1293.0 | 1189.0 |

Figure 37A:
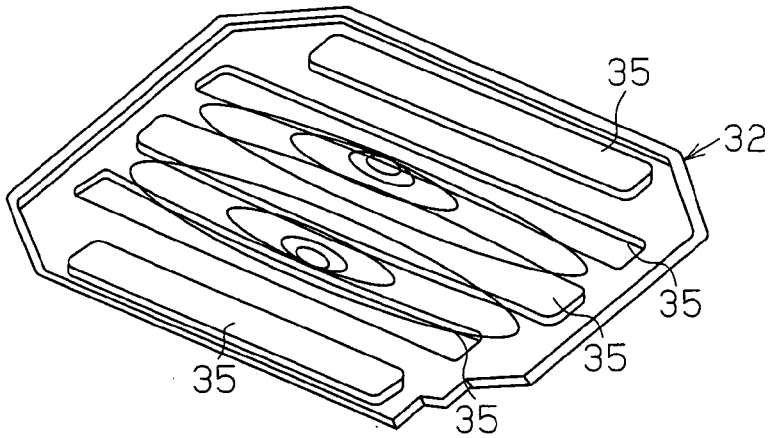
FIG. 37 shows natural vibration modes of the top plate structure for the air conditioner of the fifth embodiment, where FIG. 37(*a*) shows a primary mode and FIG. 37(*b*) shows a secondary mode.
Figure 37B:
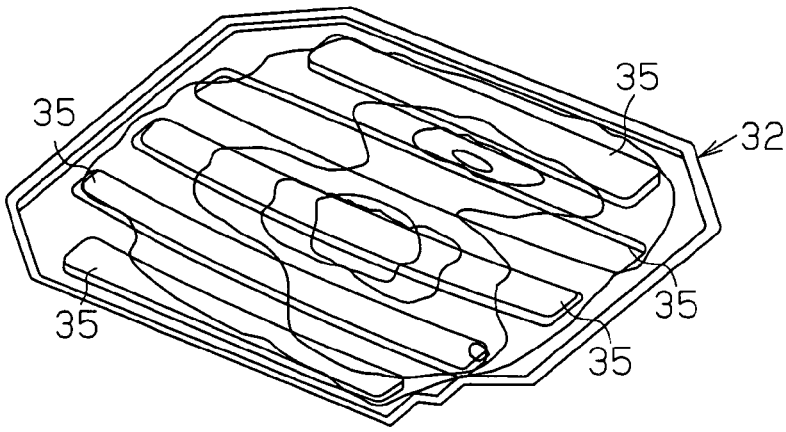

FIGS. 37(*a*) and 37(*b*) show the primary and secondary natural vibration modes of the top plate. The analysis results shown in Table 9 and FIGS. 35 to 37 will be summarized as follows.

(a) Top plates including double-side reinforcement ribs 35A to 35E that project from the two sides of the top plates have a smaller maximum deflection than the top plates including single-side reinforcement ribs 35 that project from only one side of the top plate. For example, when the depth of the reinforcement ribs 35A to 35E is 8.0 mm, the top plate including the single-side ribs has a maximum deflection of 1.03 mm, whereas the top plate including the double-side ribs has a maximum deflection of 0.75 mm, which is decreased by 27.2%.

(b) When compared with top plates including the single-side ribs, the top plates including the double-side ribs have a lower primary resonance rotation speed and a higher secondary resonance rotation speed. Further, as shown in FIG. 37, the primary and secondary natural vibration modes of the top plate including the double-side ribs are switched from the primary and secondary natural vibration modes of the top plate including the single-side ribs.

(c) A top plate having the double-side ribs has a lower primary resonance rotation speed. However, fan motor attachment portions of the top plate are located near a node of the primary natural vibration mode. Thus, it is believed that the primary natural vibration mode is difficult to excite with the force of the vibrations added by the fan motor. Further, the top plate including the double-side ribs has primary and secondary resonance rotation speeds less close to each other than the top plate including the single-side ribs. As a result, the top plate including the double-side ribs in general tends to have better dynamic characteristics. Further, by appropriately combining the number of reinforcement ribs, the length and depth of each reinforcement rib, and the distance between the reinforcement ribs as design parameters, it is believed that the fan motor attachment portions may be located at a node of a natural vibration mode of the top plate. In this case, vibrations of the top plate will not be excited or will be less likely to be excited by the force of the vibrations added by the fan motor. This significantly reduces the noise of the indoor unit.

Sixth Embodiment

Figure 38:
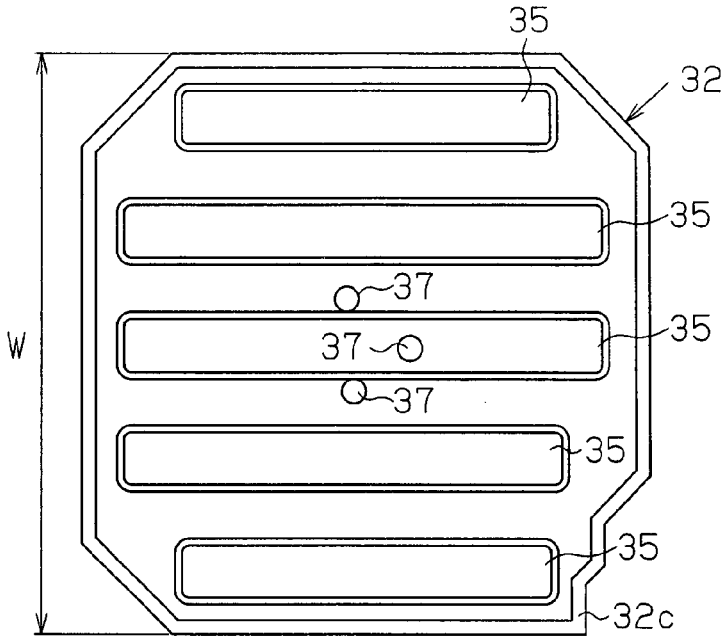
FIG. 38 is a bottom view showing a top plate structure for an air conditioner according to a sixth embodiment.
Figure 39:
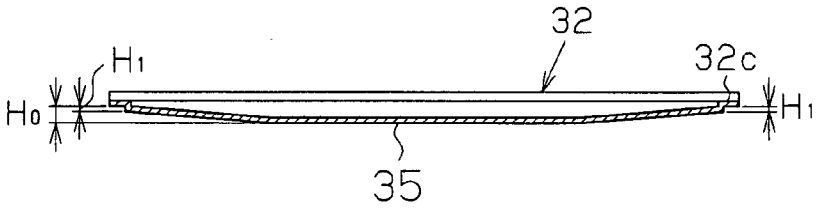
FIG. 39 is a cross-sectional view taken in a longitudinal direction of reinforcement ribs in the top plate structure for the air conditioner of the sixth embodiment.

FIGS. 38 and 39 show a top plate structure for an air conditioner for installation at a high location according to a sixth embodiment of the present invention.

In this case, in the same manner as the first embodiment, a top plate 32 is formed to be optimal for application to a body casing 3 for an air conditioner (indoor unit) that is the same as that of the prior art example illustrated in FIGS. 41 to 43.

The top plate 32 has a plate thickness t of about 0.6 mm and is thinner than the prior art top plate (0.8 mm) and is formed to have a substantially hexagonal shape in correspondence with the shape of the cassette body casing 3 included in the ceiling concealed air conditioner as shown in FIG. 33. A hook-shaped rim portion 32*c* is formed along the periphery of the top plate 32 to fit the top plate 32 to the periphery of an upper end portion of a heat insulating member 3*a* (refer to FIG. 41), which forms the side wall of the body casing 3.

The top plate 32 includes five parallel reinforcement ribs 35 arranged in parallel in the widthwise W direction of the top plate 32 as shown in FIG. 38 and flat portions formed between the parallel reinforcement ribs 35. The parallel reinforcement ribs 35 each have a trapezoidal cross-section and is formed to be shallow at the end portions relative to the longitudinal direction and deep in its middle portion as shown in FIG. 39. The depth of the two end portions of each reinforcement rib 35 is indicated by H1, and the depth of the middle portion is indicated by H0. In the present embodiment, each reinforcement rib 35 has the shape of a ship bottom in the longitudinal direction. This lowers the maximum deflection and increases the resonance rotation speed. Thus, the cost of the top plate can be expected to be further reduced due to reduction in material cost. The other parts and advantages of the present embodiment are the same as in the first embodiment and will not be described.

Seventh Embodiment

Figure 40:
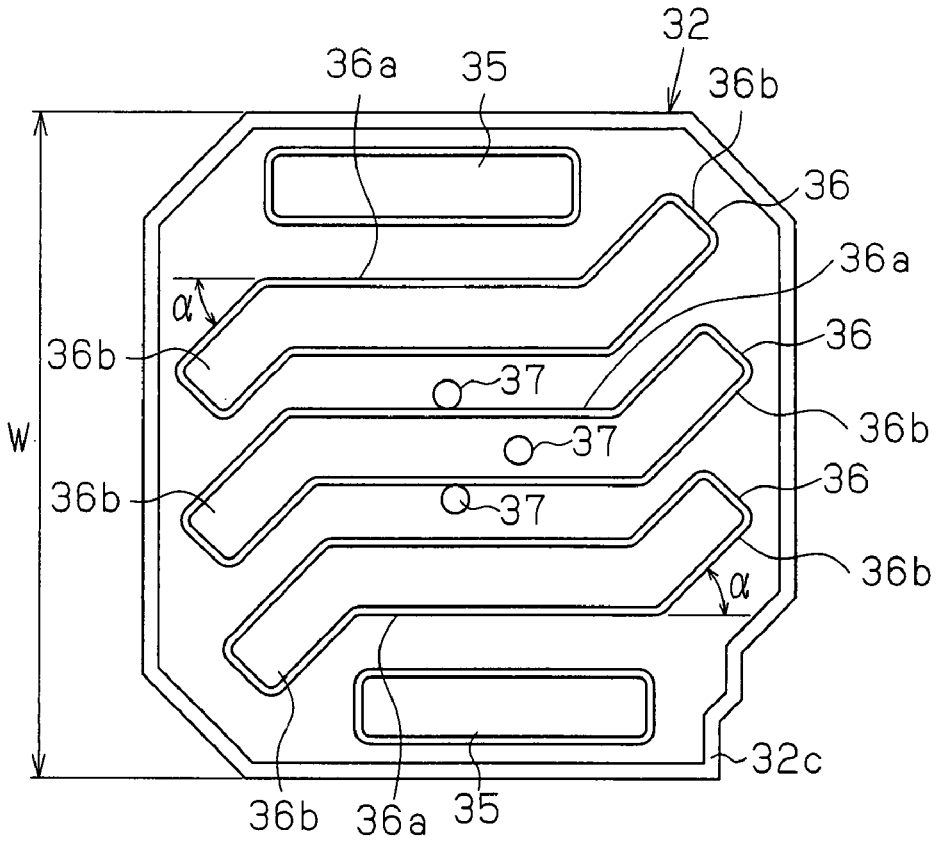
FIG. 40 is a bottom view showing a top plate structure for an air conditioner according to a seventh embodiment of the present invention.

FIG. 40 shows a top plate structure for an air conditioner for installation at a high location according to a seventh embodiment of the present invention.

In this case, in the same manner as the first embodiment, a top plate 32 is formed to be optimal for application to a body casing 3 for an air conditioner (indoor unit) that is the same as that of the prior art example illustrated in FIGS. 41 to 43.

The top plate 32 has a plate thickness t of about 0.6 mm and is thinner than the prior art top plate (0.8 mm) and is formed to have a substantially hexagonal shape in correspondence with the shape of the cassette body casing 3 included in the ceiling concealed air conditioner as shown in FIG. 40. A hook-shaped rim portion 32*c* is formed along the periphery of the top plate 32 to fit the top plate 32 to the periphery of an upper end portion of a heat insulating member 3*a* (refer to FIG. 41), which forms the side wall of the body casing 3.

The top plate 32 has two parallel reinforcement ribs 35, which are arranged in parallel, and non-parallel reinforcement ribs 36. The parallel reinforcement ribs 35 are arranged outward from the non-parallel reinforcement ribs 36. Each non-parallel reinforcement rib 36 has a parallel portion 36*a*, which extend parallel to the parallel reinforcement ribs 35, and non-parallel portions 36*b*, which extend from the two distal ends of the parallel portion 36*a* at a predetermined angle $\alpha$. In the widthwise direction of the top plate 32, the parallel reinforcement ribs 35 are formed at the outermost side positions, and three non-parallel reinforcement ribs 36 are formed between the parallel reinforcement ribs 35. Further, the non-parallel portions 36*b* of the non-parallel reinforcement ribs 36 extend outward at a predetermined angle α (45 degrees in the present embodiment) from the two distal ends of the parallel portions 36*a* in opposite directions. Further, the top plate 32 has flat portions formed between the parallel reinforcement ribs 35 and the non-parallel reinforcement ribs 36 and between the non-parallel reinforcement ribs 36.

The parallel reinforcement ribs 35 and 36 each have a trapezoidal cross-section. The reinforcement ribs 35 and 36 each have a width w equal to the distance D between the reinforcement ribs 35 and 36 and a depth H of 8.8 mm. Further, each reinforcement rib 35 and 36 has a width w that is preferably 5 to 15% of the width W of the top plate 32, and more preferably 10% of the width W. When this is set to less than 5%, an excessively large number of reinforcement ribs must be formed thereby making the reinforcement ribs difficult to form. If this is set to more than 15%, there will not be enough reinforcement ribs and the effect of the reinforcement ribs will become insufficient. Further, in this case, the reinforcement ribs 35 and 36 located in the middle has a linear shape. This strengthens the rigidity of the portions of the top plate 32 to which the fan motor 9 is attached, lowers the maximum deflection, and increases the resonance rotation speed. Thus, the cost of the top plate can be expected to be reduced by reduction in material cost. The other parts of the present embodiment are the same as the first embodiment and will not be described.

Although the width w of each reinforcement rib and the distance D between the reinforcement ribs are substantially equal to each other in the above additional embodiments, the width w of each reinforcement rib may differ from the distance D between the reinforcement ribs. In that case, the freedom for setting rigidity (deflection characteristics), strength, and vibration characteristics of the top plate 32 is improved.

The invention claimed is:

1. A top plate structure for an air conditioner including a body casing for accommodating a fan, a fan motor, and a heat exchanger, the top plate structure comprising:

a top plate forming a top surface of the body casing and supporting the fan and the fan motor; and parallel reinforcement ribs each having a trapezoidal cross-section and a non-parallel reinforcement rib having a trapezoidal cross-section arranged on the top plate, wherein the parallel reinforcement ribs are arranged in parallel, and the non-parallel reinforcement rib includes a parallel portion extending parallel to the parallel reinforcement ribs and a non-parallel portion extending from an end of the parallel portion at a predetermined angle, the predetermined angle being in the range of forty-five to ninety degrees, the parallel reinforcement ribs are formed at outermost positions and at a middle position of the top plate, and the non-parallel reinforcement rib is formed between the parallel reinforcement ribs.

2. The top plate structure for an air conditioner according to claim 1, wherein the non-parallel portion of the non-parallel reinforcement rib extends outwardly from at least one end of the parallel portion of non-parallel reinforcement rib.

3. The top plate structure for an air conditioner according to claim 1, wherein each reinforcement rib has a width that is substantially equal to a distance between the reinforcement ribs.

4. The top plate structure for an air conditioner according to claim 1, wherein each reinforcement rib has a width that differs from a distance between the reinforcement ribs.

5. The top plate structure for an air conditioner according to claim 1, wherein each reinforcement rib has a width that is 5 to 15% of a width of the top plate.

6. The top plate structure for an air conditioner according to claim 1, wherein, among the plurality of reinforcement ribs, the reinforcement rib located at the middle position of the top plate is formed to be linear.

7. The top plate structure for an air conditioner according to claim 1, wherein each reinforcement rib has a depth set in a range of 7 to 11 mm.

8. The top plate structure for an air conditioner according to claim 1, wherein, among the plurality of reinforcement ribs, the reinforcement rib located at the middle position of the top plate has a depth that differs from the depth of the other reinforcement ribs.

9. The top plate structure for an air conditioner according to claim 1, wherein the plurality of reinforcement ribs extend alternately from a front side or a rear side of the top plate.

10. The top plate structure for an air conditioner according to claim 1, wherein each reinforcement rib has two ends at which the depth is set to be shallower than the depth at a middle portion.

11. The top plate structure for an air conditioner according to claim 1, wherein the top plate has a plate thickness set in a range of 0.6 to 0.7 mm.

12. The top plate structure for an air conditioner according to claim 1, wherein the air conditioner is of a type for installation at a high location.

* * * * *